US010727605B2

(12) United States Patent
Sorrell

(10) Patent No.: US 10,727,605 B2
(45) Date of Patent: Jul. 28, 2020

(54) HIGH OPERATIONAL FREQUENCY FIXED MESH ANTENNA REFLECTOR

(71) Applicant: Eagle Technology, LLC, Melbourne, FL (US)

(72) Inventor: Rodney Sorrell, Melbourne, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 63 days.

(21) Appl. No.: 16/122,327

(22) Filed: Sep. 5, 2018

(65) Prior Publication Data

US 2020/0076089 A1 Mar. 5, 2020

(51) Int. Cl.

| | |
|---|---|
| ***H01Q 15/14*** | (2006.01) |
| ***H01Q 15/20*** | (2006.01) |
| ***H01Q 15/16*** | (2006.01) |
| ***H01Q 1/12*** | (2006.01) |

(52) U.S. Cl.

CPC ..... *H01Q 15/168* (2013.01); *H01Q 1/12* (2013.01); *H01Q 15/147* (2013.01)

(58) Field of Classification Search

CPC .... H01Q 15/147; H01Q 15/16; H01Q 15/168; H01Q 15/161; H01Q 19/19; H01Q 19/192; H01Q 1/08; H01Q 1/12; H01Q 15/14; H01Q 15/141; H01Q 15/142; H01Q 15/20; H01Q 19/10; H01Q 1/28; H01Q 1/288

See application file for complete search history.

(56) References Cited

U.S. PATENT DOCUMENTS

| | | | | |
|---|---|---|---|---|
| 3,680,144 | A * | 7/1972 | Low | H01Q 1/288 343/781 R |
| 4,498,087 | A * | 2/1985 | Imbiel | H01Q 15/161 343/915 |
| 4,511,215 | A | 4/1985 | Butler | |
| 4,613,870 | A * | 9/1986 | Stonier | H01Q 15/161 343/915 |
| 4,642,652 | A * | 2/1987 | Herbig | H01Q 15/161 343/915 |
| 4,750,002 | A | 6/1988 | Kommineni | |
| 4,811,033 | A | 3/1989 | Ahl et al. | |
| 4,899,167 | A * | 2/1990 | Westphal | H01Q 15/162 343/912 |

(Continued)

*Primary Examiner* — Tho G Phan

(74) *Attorney, Agent, or Firm* — Fox Rothschild LLP; Robert J. Sacco; Carol E. Thorstad-Forsyth

(57) ABSTRACT

A reflector antenna, preferably a fixed mesh reflector antenna, and a process for manufacturing the reflector antenna, is disclosed that includes forming a support structure, placing a reflector surface on a mold, attaching the support structure to the reflector surface, measuring the geometry of the reflector surface, adjusting the surface geometry of the reflector if appropriate to obtain improved accuracy for the reflector surface, and fixedly connecting the support structure and the reflector surface. In an embodiment, the antenna reflector system includes a mesh reflector surface, a plurality of spline support elements, a plurality of splines connected to the reflector surface, and a plurality of adjustable spline supports attachable to the spline support elements and the splines, wherein the adjustable spline supports are adjustably repositionable with respect to the spline support elements, and also fixedly connectable to the spline support elements.

9 Claims, 14 Drawing Sheets

(56) References Cited

U.S. PATENT DOCUMENTS

| | | | | |
|---|---|---|---|---|
| 5,047,788 | A * | 9/1991 | Gillard | H01Q 15/147 343/721 |
| 5,162,811 | A | 11/1992 | Lammers et al. | |
| 5,440,320 | A | 8/1995 | Lach et al. | |
| 5,488,383 | A | 1/1996 | Friedman et al. | |
| 5,592,336 | A | 1/1997 | Saito et al. | |
| 5,680,145 | A | 10/1997 | Thomson et al. | |
| 5,686,930 | A | 11/1997 | Brydon | |
| 5,969,695 | A | 10/1999 | Bassily et al. | |
| 6,018,328 | A | 1/2000 | Nolan et al. | |
| 6,195,067 | B1 | 2/2001 | Gilger | |
| 6,278,416 | B1 | 8/2001 | Harless | |
| 6,384,800 | B1 | 5/2002 | Bassily et al. | |
| 8,654,033 | B2 | 2/2014 | Sorrell et al. | |
| 8,860,627 | B2 | 10/2014 | Scolamiero et al. | |
| 9,337,544 | B2 | 5/2016 | Theunissen et al. | |

* cited by examiner

HIGH OPERATIONAL FREQUENCY FIXED MESH ANTENNA REFLECTOR

FIELD OF THE INVENTION

The present invention relates to antennas or reflectors for terrestrial or space applications and in an embodiment relates to a new and improved high operational frequency antenna or reflector that is lightweight and highly reflective.

BACKGROUND OF THE INVENTION

The use of large reflectors for satellite communication networks is becoming more widespread as the demand for mobile communications increases. One area where demand is increasing is for antennas or reflectors having a diameter of approximately two (2) meters to approximately five (5) meters for high operational frequency applications (e.g., Ka-Band, V-Band).

Solid surface reflectors may be used for applications up to two (2) meters and in circumstances may be capable of achieving serviceable accuracy required for operational frequencies up to 50 GHz. However, beyond 2 meters, the mass of the reflector, the mass of the boom to position the reflector, and the spacecraft interface structure increases significantly, which may be problematic for satellite reflectors. In addition, achievable surface accuracy on solid surface reflectors greater than two (2) meters decreases making it difficult to achieve the surface accuracy required for high operational frequencies, e.g., Ka-band and greater. The surface accuracy is limited by fabrication errors typically associated with tooling and mold errors, distortions associated with elevated temperature cure required for current manufacturing techniques, and thermal elastic distortions of the reflector.

Current fixed mesh reflectors where a mesh connected to a support structure forms the surface of the reflector overcome some of the limitations of solid surface reflectors. For example, the mass of the mesh reflector is typically lower than competing solid surface reflectors. The fixed mesh reflector also advantageously has near zero acoustical loads, and reflectivity and cross polarization performance of fixed mesh reflectors is comparable to solid surface reflectors. However, like solid surface reflectors, achievable surface accuracy on fixed mesh reflectors greater than two (2) meters decreases making it difficult to achieve the surface accuracy required for high operational frequencies, e.g., Ka-band and greater. Surface accuracy is limited in fixed mesh reflectors by fabrication errors caused by the mold and tooling, distortions induced into the mesh surface during mesh surface installation, and thermal elastic distortions of the reflector.

The present invention in one or more embodiments and aspects preferably overcomes, alleviates, or at least reduces some of the disadvantages of the prior solid surface and mesh reflectors.

SUMMARY OF THE INVENTION

The summary of the disclosure is given to aid understanding of a reflector, reflector system, and method of manufacturing the same, and not with an intent to limit the disclosure or the invention. The present disclosure is directed to a person of ordinary skill in the art. It should be understood that various aspects and features of the disclosure may advantageously be used separately in some instances, or in combination with other aspects and features of the disclosure in other instances. Accordingly, variations and modifications may be made to the reflector, reflector system, or its method of manufacture and operation to achieve different effects.

Certain aspects of the present disclosure provide a reflector, a reflector system, and/or a method of manufacturing and using a reflector and reflector system, preferably a fixed mesh reflector and reflector system, for high operational frequencies. In an embodiment, the reflector and/or reflector system has superior surface accuracy and geometry.

In an embodiment, a process for manufacturing an antenna reflector is disclosed. The process in an aspect includes providing a support structure, which in an embodiment may include assembling the support structure; placing a reflector surface on a mold; attaching the support structure to the reflector surface; measuring the geometry of the reflector surface; adjusting the surface geometry of the reflector if appropriate to obtain improved accuracy for the reflector surface; and fixedly connecting, preferably permanently fixedly connecting, the support structure and the reflector surface. The process in an embodiment includes the reflector surface formed of a mesh that has openings and wherein placing the reflector surface on a mold includes tensioning the mesh on a concave mold that replicates the desired shape of the reflector surface.

The process of attaching the support structure to the reflector surface in an aspect occurs while the reflector surface and support structure are on the mold, and the process of measuring the geometry of the reflector surface, the process of adjusting the surface geometry of the reflector, and the process of fixedly connecting, preferably permanently fixedly connecting, the support structure and the reflector surface occurs while the reflector surface and support structure are removed from the mold. The process of fixing the support structure and the reflector surface includes in an embodiment at least one of the group consisting of gluing, bonding, welding, fastening, mechanically fastening, using fasteners, and combinations thereof. In a further aspect, the process of adjusting the surface geometry of the reflector includes adjusting the interfaces between the support structure and the surface of the reflector.

In a further embodiment, the support structure includes a plurality of adjustable supports wherein adjusting the surface of the reflector includes adjusting the adjustable supports to change the surface of the reflector. The support structure in an embodiment includes a plurality of splines and wherein adjusting the surface geometry of the reflector includes adjusting the configuration of the splines. The support structure includes a plurality of straight, non-curved splines and during the process of assembling the support structure the straight, non-curved splines are configured into a curved shape.

In an embodiment, the support structure includes a plurality of splines and a plurality of adjustable spline supports to receive one or more splines, and adjusting the surface geometry of the reflector includes adjusting one or more of the adjustable spline supports to change the configuration of at least one spline. In an aspect, the plurality of splines includes an edge spline forming a circumferential rim for the reflector surface, and a plurality of generally parallel, straight, non-curved interior splines that are curved during the process of manufacturing the reflector. The support structure may further include one or more support elements and one or more of the adjustable spline supports are adjusted to change the distance at least one of the interior splines is positioned relative to at least one support element.

The support structure may further include a rim assembly, and the process of adjusting the surface geometry of the reflector occurs after the process of attaching the support structure to the reflector surface, and wherein the process of adjusting the surface geometry of the reflector includes adjusting one or more adjustable spline supports to change the distance the edge spline is positioned relative to the rim assembly. In one aspect, the plurality of adjustable spline supports include edge spline supports and node fittings, and the process of assembling the support structure includes connecting the edge spline supports to the edge spline and connecting the node fittings to the interior splines and setting the positions of the splines prior to or during the process of attaching the supporting structure to the reflector surface, and thereafter measuring, and if appropriate to achieve improved accuracy for the reflector surface, adjusting at least one of the group consisting of the edge spline supports, the node fittings, and combinations thereof to reposition the splines, and thereafter permanently fixing the node fittings to the support structure and splines, and permanently fixing the edge spline supports to the support structure and splines.

Further processes of manufacturing a reflector are disclosed, including a process of manufacturing a fixed mesh reflector that includes in an example, providing a support structure; tensioning the mesh on a mold; attaching the support structure to the mesh; measuring the geometry of the mesh surface; thereafter adjusting the surface geometry of the mesh surface; and thereafter fixedly connecting, preferably permanently fixing, the support structure and the reflector surface to retain the geometry of the mesh surface. In an embodiment, the support structure is assembled at least partially off the mold and the support structure is attached to the reflector surface while the reflector surface is on the mold. In an aspect, measuring the mesh surface geometry, adjusting the surface geometry, and fixedly connecting, preferably permanently fixedly connecting, the support structure and the reflector surface is performed while the support structure and reflector surface assembly are off the mold.

An embodiment of an antenna reflector is also disclosed. The antenna reflector includes in an embodiment a reflector surface; a plurality of spline support elements; a plurality of splines fixedly connected to the reflector surface; and a plurality of adjustable spline supports attachable to the spline support elements, and configured and adapted to retain the splines, wherein at least one of the adjustable spline supports is configured and adapted to be adjustably repositionable with respect to the spline support elements to change the configuration of at least one spline in a first mode, and also configured and adapted thereafter to be fixedly connected, preferably permanently fixedly connected, to the spline support elements in a second mode. In an aspect, the reflector surface comprises a mesh formed of conductive filaments with openings and the mesh is fixedly connected to the splines.

The antenna reflector may further include a plurality of generally parallel interior splines, and the plurality of spline supports include node fittings for retaining the interior splines, the node fittings having at least one flange with one or more flange openings for receiving one or more locking screws, the node fitting being adjustably repositionable with respect to the spline support elements in a first mode by loosening and tightening at least one of the locking screws, and thereafter being fixedly connected, preferably permanently fixedly connected, to the spline support element in a second mode. The spline support element in an embodiment has one or more vertical slots aligned with at least one of the one or more flange openings, the at least one locking screw extending through the flange opening and at least one of the vertical slots to secure the node fitting to the spline support element and permit repositioning of the node fitting, the spline support element further comprising one or more openings associated with and configured to be in proximity to the at least one flange of the node fitting, the openings further configured and adapted to receive at least a portion of a node fitting adjustment mechanism to adjust and reposition the node fitting on the spline support element in the first mode. The node fitting adjustment mechanism according to one aspect includes a portion for abutting against the flange of at least one node fitting.

The antenna reflector in an embodiment includes a rim assembly, an edge spline, and a plurality of edge spline supports for retaining the edge spline, the edge spline supports being attachable to the rim assembly, wherein at least one of the edge spline supports is configured and adapted to be adjustably repositionable with respect to the rim assembly to change the configuration of at least one spline in a first mode, and the edge spline support is thereafter fixedly connected, preferably permanently fixedly connected, to the rim assembly in a second mode. The edge spline support optionally includes a base fitting for receiving the edge spline and a stanchion receivable and repositionable within the rim assembly in a first mode, and fixedly connected, preferably permanently fixedly connected, to the rim assembly in a second mode. The edge spline support in an embodiment optionally includes a pivot fitting for receiving at least one interior spline, the pivot fitting adjustably positionable with respect to the base fitting in a first mode and fixedly connected, preferably permanently fixedly connected, to the edge spline support in a second mode.

In yet another example an antenna reflector kit system is disclosed. The antenna reflector system includes a wire mesh configurable into a reflector surface; a plurality of spline support elements; a plurality of splines connectable to the wire mesh to form the reflector surface; a plurality of adjustable spline supports connectable to at least one spline; and a plurality of spline support adjustment mechanisms configured for adjusting the position or configuration of the adjustable spline supports with respect to the spline support elements to reposition the splines to alter the shape of the reflector surface.

BRIEF DESCRIPTION OF THE DRAWINGS

The various aspects, features and embodiments of the reflector, reflector system and their method of manufacture and operation will be better understood when read in conjunction with the figures provided. Embodiments are provided in the figures for the purpose of illustrating aspects, features and/or various embodiments of the reflector, reflector structure, reflector system, and their method of manufacture and operation, but the claims should not be limited to the precise arrangement, structures, features, aspects, embodiments or devices shown, and the arrangements, structures, subassemblies, features, aspects, methods, processes, embodiments, and devices shown may be used singularly or in combination with other arrangements, structures, subassemblies, features, aspects, methods, processes, embodiments, and devices. The drawings are not necessarily to scale and are not in any way intended to limit the scope of the claims, but are merely presented to illustrate and describe various embodiments, aspects and features of the reflector, reflector system, preferably fixed mesh reflector and/or fixed mesh reflector system, and/or their method of manufacture and operation to one of ordinary skill in the art.

DETAILED DESCRIPTION

Figure 1:
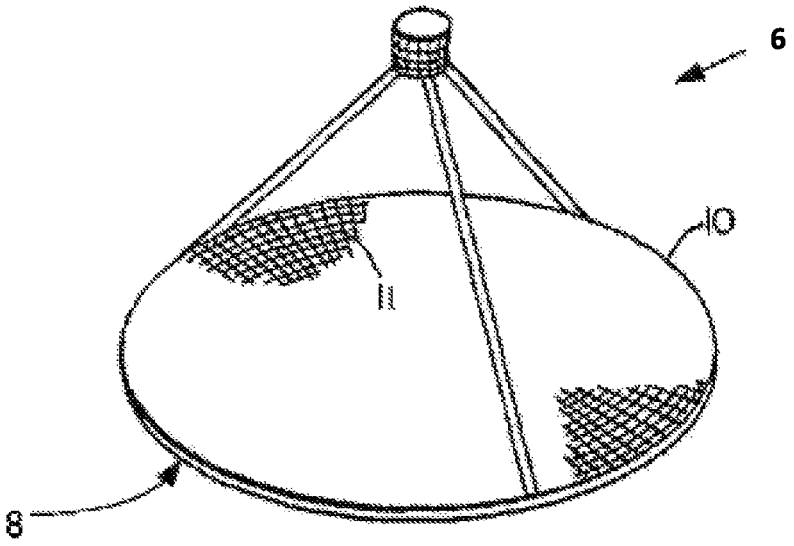
FIG. 1 is a top perspective view of a reflector according to an embodiment of the invention.

The following description is made for illustrating the general principles of the invention and is not meant to limit the inventive concepts claimed herein. In the following detailed description, numerous details are set forth in order to provide an understanding of the reflector, the reflector structure, the reflector system, and their method of manufacture and operation, however, it will be understood by those skilled in the art that different and numerous embodiments of the reflector, reflector structure, reflector system, and their method of manufacture and operation may be practiced without those specific details, and the claims and invention should not be limited to the embodiments, subassemblies, features, processes, methods, aspects, or details specifically described and shown herein. Further, particular features described herein can be used in combination with other described features in each of the various possible combinations and permutations.

Accordingly, it will be readily understood that the components, aspects, features, elements, and subassemblies of the embodiments, as generally described and illustrated in the figures herein, can be arranged and designed in a variety of different configurations in addition to the described embodiments. It is to be understood that the reflector and reflector system may be used with many additions, substitutions, or modifications of form, structure, arrangement, proportions, materials, and components which may be particularly adapted to specific environments and operative requirements without departing from the spirit and scope of the invention. The following descriptions are intended only by way of example, and simply illustrate certain selected embodiments of a reflector, a reflector system, and their method of manufacture and operation. For example, while the reflector is shown and described in examples with particular reference to its use as a satellite antenna for high operational frequencies, it should be understood that the reflector and reflector system may have other applications as well. Additionally, while the reflector is shown and described as a fixed mesh reflector, it should be understood that the reflector and invention has application to solid surface reflectors, triax weave reflectors, and other reflectors as well. The claims appended hereto will set forth the claimed invention and should be broadly construed to cover reflectors, reflector structures, mesh reflectors, fixed mesh reflectors, solid surface reflectors, and/or systems, and their method of manufacture and operation, unless otherwise clearly indicated to be more narrowly construed to exclude embodiments, elements and/or features of the reflector, reflector system and/or their method of manufacture and operation.

It should be appreciated that any particular nomenclature herein is used merely for convenience, and thus the invention should not be limited to use solely in any specific application identified and/or implied by such nomenclature, or any specific structure identified and/or implied by such nomenclature. Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and the terms "comprises" and/or "comprising" specify the presence of the stated features, integers, steps, operations, elements and/or components, but do not preclude the presence or addition of one or more other features, integers, steps, operations, elements, components, and/or groups thereof.

In the following description of various embodiments of the reflector, reflector system, and/or method of manufacture and operation, it will be appreciated that all directional references (e.g., upper, lower, upward, downward, left, right, lateral, longitudinal, front, rear, back, top, bottom, above, below, vertical, horizontal, radial, axial, interior, exterior, clockwise, and counterclockwise) are only used for identification purposes to aid the reader's understanding of the present disclosure unless indicated otherwise in the claims, and do not create limitations, particularly as to the position, orientation, or use in this disclosure. Features described with respect to one embodiment typically may be applied to another embodiment, whether or not explicitly indicated.

Connection references (e.g., attached, coupled, connected, and joined) are to be construed broadly and may include intermediate members between a collection of elements and relative movement between elements unless otherwise indicated. As such, connection references do not necessarily infer that two elements are directly connected and/or in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary and may not be to scale.

The following discussion omits or only briefly describes conventional features of reflectors, including mesh reflectors and reflector systems and structures, which are apparent to those skilled in the art. It is assumed that those skilled in the art are familiar with the general structure, operation and manufacturing techniques of reflectors, and in particular fixed reflectors and fixed mesh reflectors. It may be noted that a numbered element is numbered according to the figure in which the element is introduced, and is typically referred to by that number throughout succeeding figures.

In accordance with an embodiment, a new and improved reflector, mesh reflector, fixed mesh reflector, and/or reflector system is provided with improved surface geometry, e.g., greater surface accuracy, for higher operational frequencies such as, for example, Ka-Band and V-Band. In an embodiment a new and improved technique for manufacturing reflectors with improved surface geometry such as, for example, increased surface accuracy, is disclosed that in an aspect has application to fixed reflectors, preferably fixed mesh reflectors. The reflector and reflector system, preferably fixed reflector and/or fixed mesh reflector system, and/or manufacturing technique and operation, have application in an embodiment to such reflectors and reflector systems having diameters as small as about 2 meters to as large as about 5 meters, and diameters there-between. Other diameters are also contemplated for such reflectors, reflector systems, and/or their manufacture and/or operation.

In an aspect a reflector antenna is disclosed. As illustrated in FIG. 1, a reflector antenna 6 has a reflector 8. The reflector 8 preferably is shaped like a dish having a circumferential rim 10 and preferably a highly accurate surface 11. The reflector preferably in an embodiment is a mesh reflector, and more preferably a fixed mesh reflector. The reflector and reflector system in an embodiment are fixed in that the surface geometry is intended not to change during deployment of the reflector. The reflector in an aspect is about two (2) meters to about five (5) meters in diameter, although other sizes are contemplated. In a further aspect, the reflector is sized and configured for high operational frequencies, such as, for example, Ka-Band for user beams and V-Band for gateway beams.

The reflector antenna 6 includes in an embodiment a support structure or frame (shown in FIGS. 2A and 2B) to support the surface (shown in FIG. 3) of the reflector. The support structure or frame, in embodiments, can be configured and arranged so the reflector, preferably the surface 11 of the reflector 8, defines a curved three-dimensional shape, such as, for example, a parabolic surface. The operational surface of the reflector, for example, may be a solid surface, a triax weave surface, or a mesh surface.

Figure 2A:
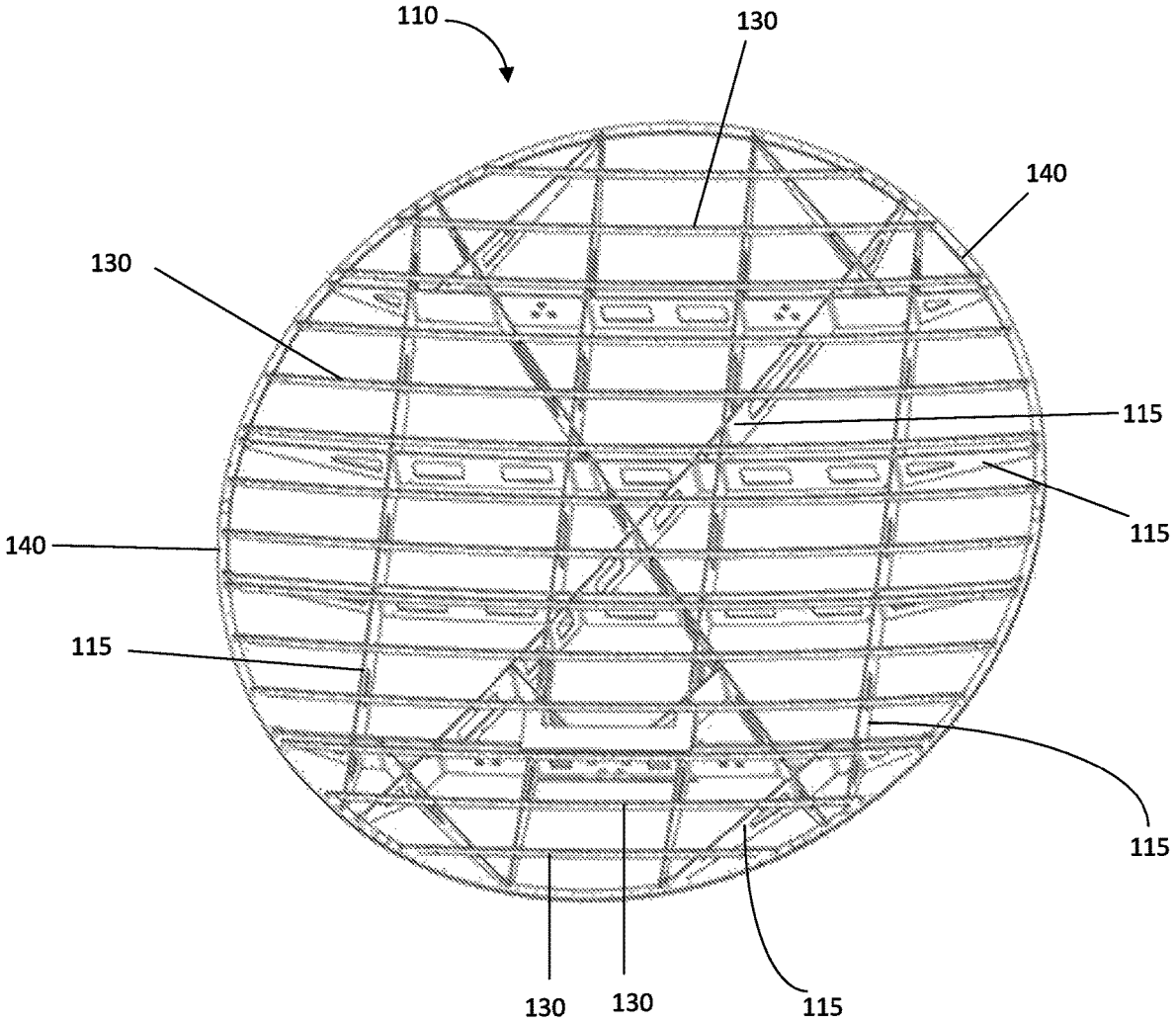
FIG. 2A is a top perspective view of an embodiment of a support structure for a reflector.

An exemplary embodiment of support structure or frame 110 for a reflector antenna 6 is shown in FIG. 2A and may comprise a number of support members or ribs 115 and other structural elements to support the surface of the reflector 8. In an aspect, the ribs 115 can interconnect in and form a number of different configurations, and the ribs may be horizontal, vertical, and or diagonal as shown in FIG. 2A. The ribs 115 may be configured differently than illustrated FIG. 2A. The ribs 115 are preferably fixedly connected together to provide structural support for the surface of the reflector 8.

Figure 2B:
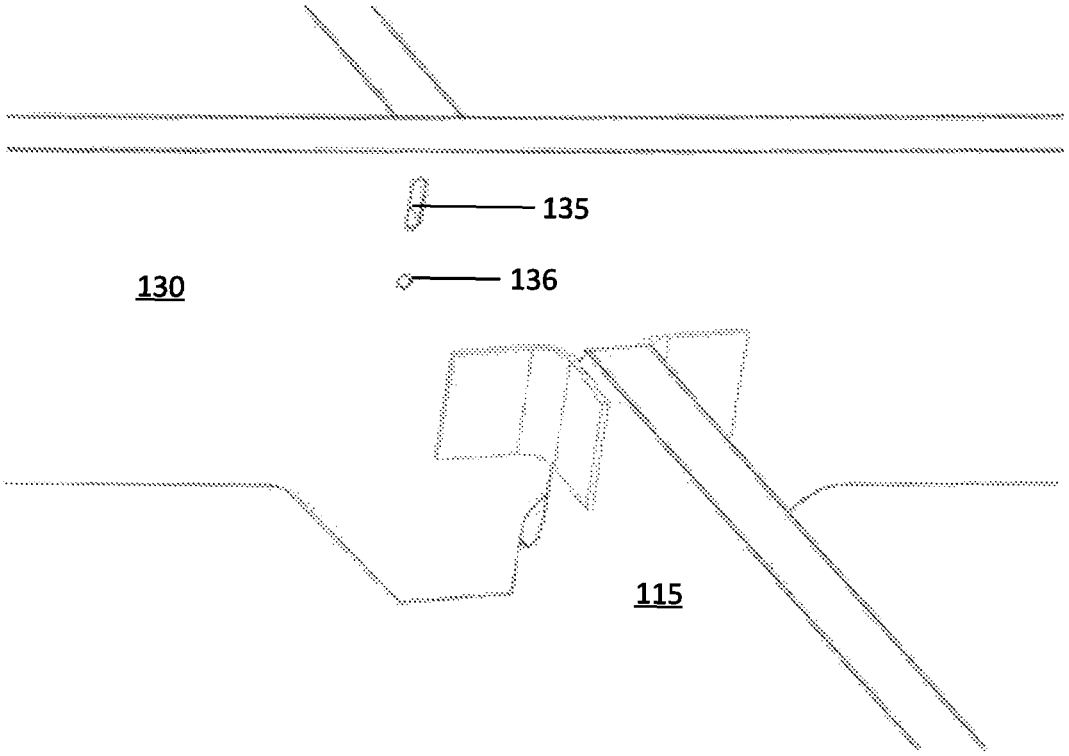
FIG. 2B is a side perspective view of a portion of a support structure for a reflector.

The frame 110 in an embodiment may also include spline support elements (SSEs) 130 and rim assembly 140. The spline support elements (SSEs) 130 in an aspect are supported by, e.g., connected to, preferably directly attached to, the support members or ribs 115. The SSEs 130 in an aspect are generally rectangular in cross-section and have a top surface that extends above the support members or ribs 115 as shown in FIG. 2B. In an aspect, the spline support elements (SSEs) 130 run parallel to each other and adjacent SSEs 130 are spaced approximately nine (9) inches apart. Other spacing distances between adjacent SSEs 130 are contemplated. Spline support elements (SSEs) 130 and/or ribs 115 in an embodiment are connected to circumferential rim assembly 140. The circumferential rim assembly 140 is in an embodiment is configured and constructed with relatively thin members having a generally rectangular cross-section. The circumferential rim assembly 140 is configured into a rim where the longer side of the rim assembly (see FIG. 4) faces upward and is perpendicular relative to the longer side of SSEs 130. The SSEs 130 in an embodiment are configured to extend above the circumferential rim assembly 140.

Figure 3:
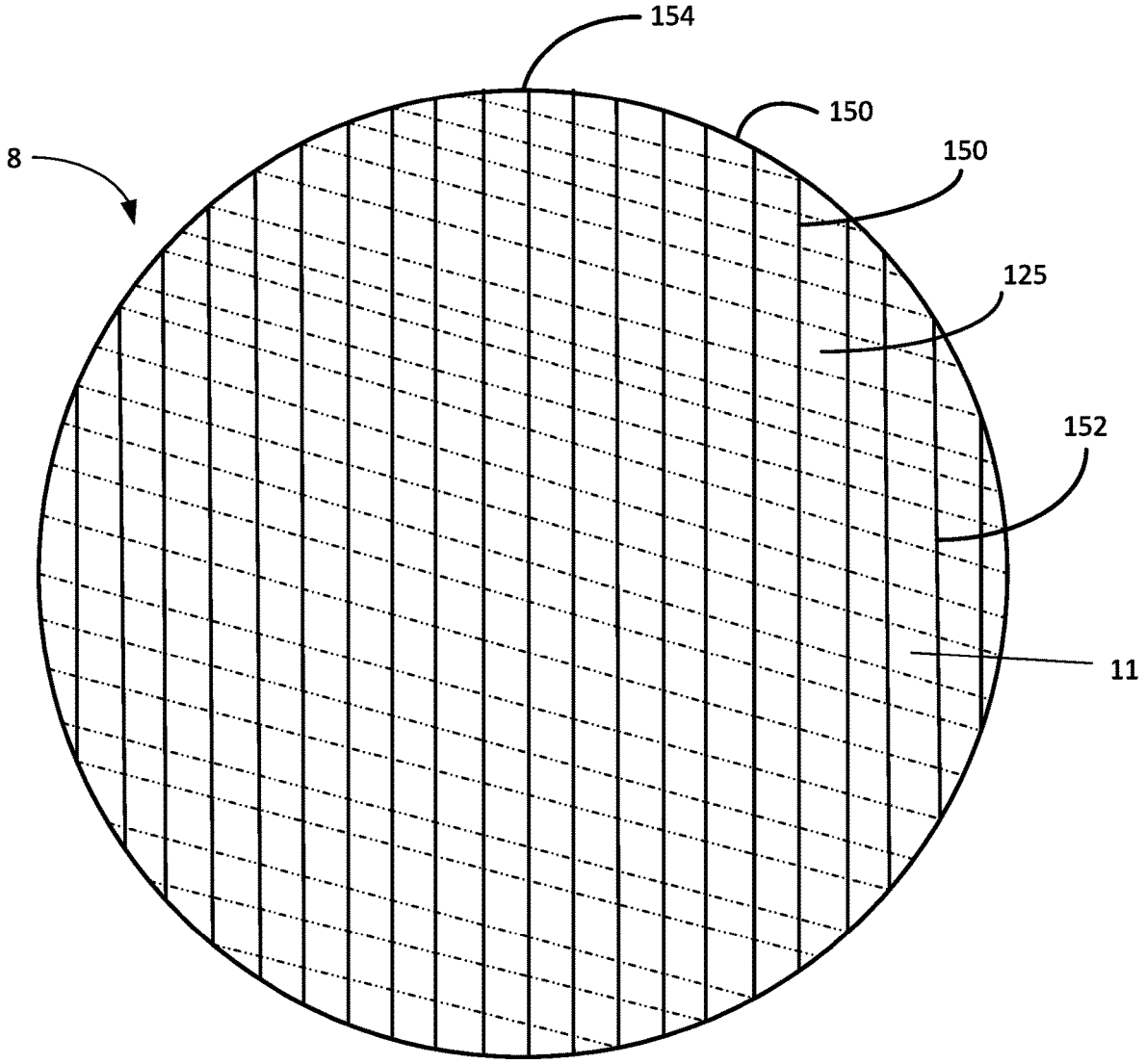
FIG. 3 is a top view of an embodiment of a surface of a reflector.

An exemplary embodiment of the surface 11 of the reflector 8 is shown in FIG. 3. The surface 11 of reflector 8 is supported by, and in preferred embodiments connected to, preferably connected directly to, splines 150. The surface 11 in a preferred embodiment is formed of a mesh material 125. The mesh 125 in an embodiment may include a plurality, e.g., two, stacked web layers. Each layer of open mesh is formed of highly conductive filaments which define openings. In an embodiment, the mesh 125 has about fifty (50) openings or pores per inch (50 ppi). The mesh 125 may be designed and configured as disclosed in U.S. Pat. No. 8,654,033, the entire contents of which are incorporated by reference. Other mesh designs, configurations, surface geometries, and shapes are contemplated for the disclosed reflector.

FIG. 3 illustrates reflector 8 with mesh 125 supported by splines 150 to form surface 11. Splines 150 include interior splines 152 extending in a generally vertical direction and edge spline 154 which forms the circumferential rim of the reflector 8. Interior splines 152 in an embodiment are relatively thin, elongated members that generally run parallel to each other and are spaced about three (3) inches apart, although other spacing distances between interior splines 152 are contemplated. Splines 150, in an aspect, are rod shaped having a circular cross-section. Edge spline 154 is also a relatively thin, elongated member that in an embodiment is formed into a loop. Edge spline 154 may be formed of one or more components. Splines 152 and 154 are preferably connected to, preferably fixedly connected directly to, mesh 125 to form mesh surface 11 of reflector 8. The surface 11, e.g., mesh 125, may be attached, preferably bonded and/or glued, to the splines 150 at about 1.5 inch intervals, but other distances between the attachment points of the splines 150 and surface 11 are contemplated.

Adjustable spline supports 160 in an embodiment extend from the frame 110 to interconnect the splines 150 to the frame 110. In an aspect, the support structure or frame 110 for the reflector includes the support members or ribs 115, the SSEs 130, and the rim assembly 140. The support structure for the reflector surface 11 may further include the splines 150, and the adjustable spline supports 160. In an embodiment, the adjustable spline supports 160 preferably extend from and are connected to the rim assembly 140 and/or the spline support elements (SSEs) 130. In an embodiment, the adjustable spline supports 160 are fixedly connected, preferably permanently fixedly connected, to the SSEs 130 and/or rim assembly 140. The adjustable spline support 160 in an aspect are adjustably secured to the SSEs 130 and/or rim assembly 140, for example with mechanical fasteners, e.g., screws, to form reflector antenna assembly, and post assembly, the adjustable spline supports 160 are permanently fixed to the SSEs 130 and/or rim assembly 140. As discussed below, the adjustable spline supports 160 may take a number of forms and configurations and permit post assembly adjustment of the surface geometry of the reflector to provide increased dimensional surface accuracy.

Figure 4:
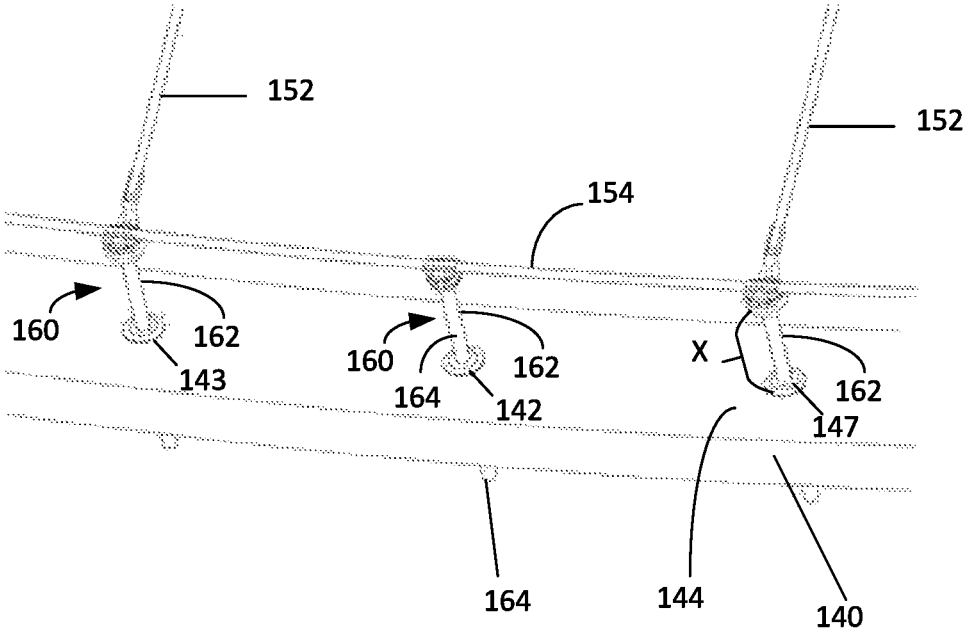
FIG. 4 is a top perspective view of a portion of a rim assembly with adjustable spline supports and splines.
Figure 5:
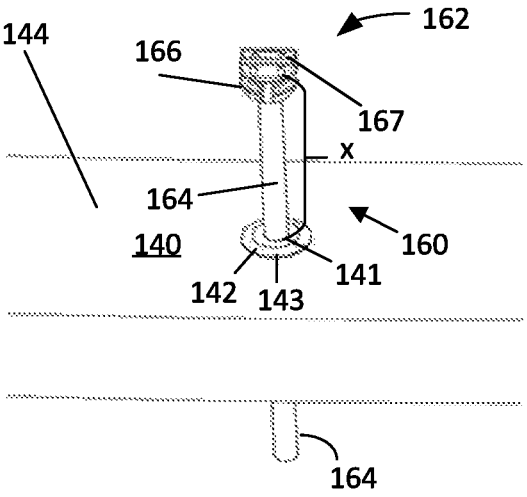
FIG. 5 is a top perspective view of an embodiment of an adjustable spline support.

In one aspect, as shown in FIG. 4, reflector 8 has a plurality of adjustable spline supports 162 that extend between the rim assembly 140 and the edge spline 154. Adjustable spline supports 162, also referred to as edge spline supports 162, includes a standoff or stanchion 164 that extends upward from rim assembly 140 as shown in FIGS. 4 and 5. In an embodiment, stanchion 164 is received in an opening 141 in the rim assembly 140 and is rotatable and slideable with respect to rim assembly 140 to adjust and reposition the stanchion 164 relative to the rim assembly 140. Rim assembly 140 includes in a preferred embodiment a bushing 142, preferably a two-piece (143,145) bushing, that extends through the opening 141 in rim assembly 140. The bushing 142 in an embodiment is metallic and preferably fixedly connected to, e.g., bonded, to the rim assembly 140, preferably in an embodiment fixedly connected to, preferably bonded to, both faces 144, 146 (see FIG. 12) of the rim assembly 140. The bushing 142 has an opening 147 for receiving the standoff, post, or stanchion 164 of the edge spline support 162. Edge spline support 162 also includes a base fitting 166 connected to standoff, post, or stanchion 164. Base fitting 166 connects to, preferably directly connects to, edge spline 154. In an embodiment, base fitting 166 includes a channel 167 to receive edge spline 154. The edge spline 154 is preferably captured in and slideable within channel 167 during assembly of the reflector, and optionally is later fixedly connected, optionally permanently fixedly connected, to base fittings 166.

Base fitting 166 in an embodiment may also be fixedly connected, preferably permanently fixedly connected, to the standoff or stanchion 164 and the stanchion or standoff 164 can be rotated with respect to the rim assembly 140 to orient the channel 167 with respect to the edge spline 154. In an embodiment, base fitting 166 can rotate or pivot with respect to the stanchion 164 to adjust the angle or orientation that channel 167 captures edge spline 154. The height or distance "x" that stanchion or standoff 164 extends from the rim assembly 140 may be adjusted in embodiments in order to change the distance between the edge spline 154 and the rim assembly 140, which effects the shape of the surface 11 of the reflector 8. During assembly, stanchion 164 is received in an opening 147 formed in the bushing 142, and may slide with respect to rim assembly 140 to adjust distance X. Alternatively, in other embodiments, stanchion or post 164 is received and slides in an opening 141 in the rim assembly 140 to adjust distance, e.g., height X. As explained, later in the manufacturing process, the stanchion 164 is fixedly connected, preferably permanently fixedly connected, to the rim assembly 140 and/or bushing 142.

Figure 6:
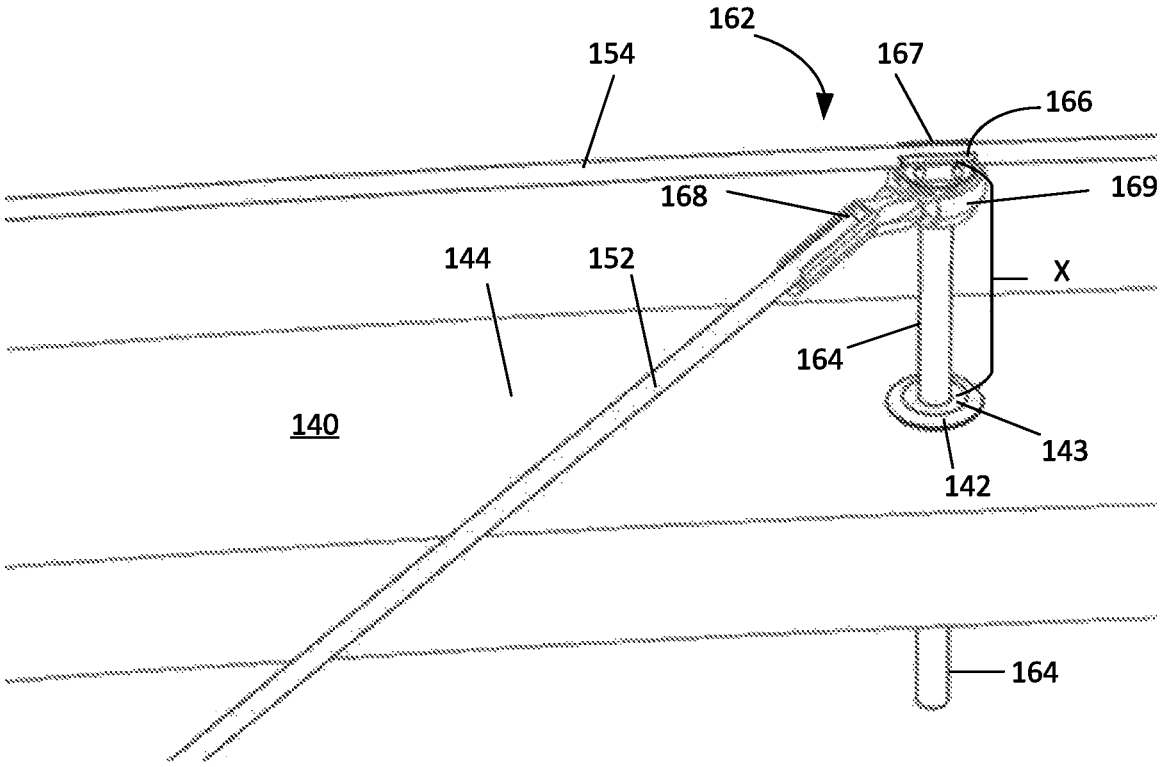
FIG. 6 is a top perspective view of an embodiment of an adjustable spline support.

In an embodiment, edge spline supports 162 may optionally include a pivot fitting 169 that is associated with and/or connects to stanchion 164, or base fitting 166, and/or to both the stanchion 164 and the base fitting 166, as shown in FIG. 6. Pivot fitting 169 connects generally parallel interior splines 152 to edge spline support 162. Pivot fitting 169 includes a mechanism, e.g., channel 168, to receive spline 152. Interior splines 152 are preferably captured in and slideable within channel 168 during assembly of the reflector, and optionally are later, fixedly connected, preferably permanently fixedly connected, to the pivot fitting 169. Pivot fitting 169 can rotate or pivot relative to the stanchion 164 and/or base fitting 166 to angularly orient the spline 152 relative to edge spline 154. More specifically, in an embodiment, pivot fitting 169 has a cavity, e.g., a hemispherical cavity, to receive the underside of the base fitting 166 that permits the pivot fitting 169 to angulate up and down relative to the base fitting 166, and to rotate about base fitting 166. During assembly the pivot fitting 169 is free to rotate and angulate with respect to the base fitting 166, e.g., edge spline support 162, and optionally pivot fitting 169 later is fixedly connected to, preferably permanently fixedly connected to, base fitting 166. In an embodiment, pivot fitting 169 is free to rotate and pivot with respect to edge spline support 162 during assembly, and optionally later after the surface accuracy of the reflector has been confirmed and/or edge spline support 162 has been adjusted, pivot fitting 169 is fixedly connected, preferably permanently fixedly connected, to edge spine support 162. In an embodiment, pivot fitting 169 may be glued or bonded to base fitting 166 to create a permanently fixed connection.

Figure 7:
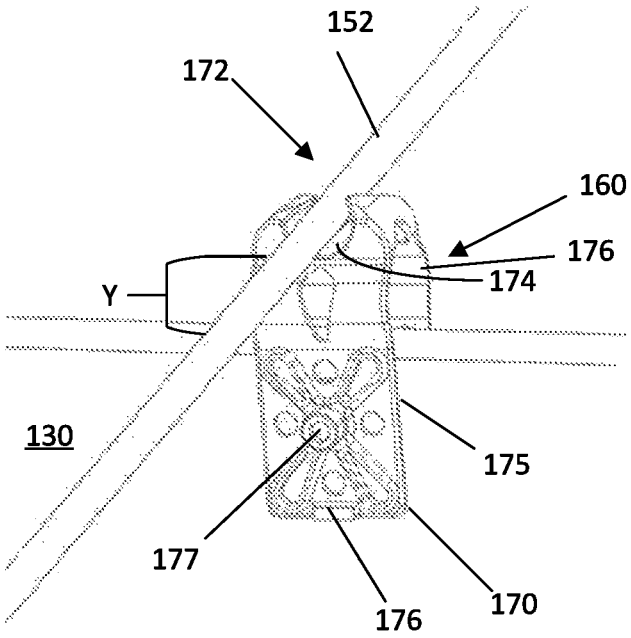
FIG. 7 is a side perspective view of an adjustable node fitting on a support structure with a spline.
Figure 8:
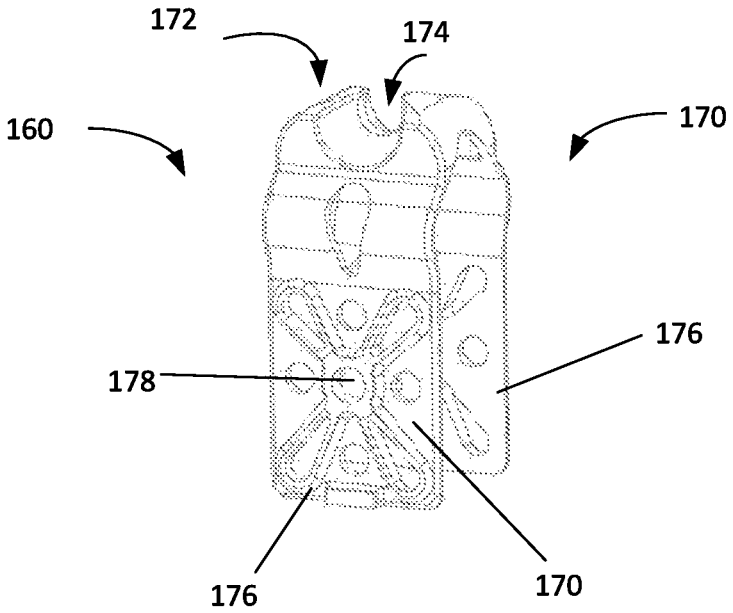
FIG. 8 is a perspective view of an embodiment of an adjustable node fitting.

Adjustable spline supports 160 may also include one or more adjustable node fittings 170 as shown in FIG. 7. Node fitting 170 includes mechanism 175 to attach the node fitting 170 to spline support elements (SSEs) 130. The SSEs 130 with the node fittings 170, in an embodiment, are the primary interface that help set and hold the reflector surface 11. Attachment mechanism 175 may include one or more flanges 176 as shown in FIGS. 7 and 8 that extend over and/or alongside SSE 130 and can attach, and in an embodiment temporarily adjustably attach, to SSE 130. The flanges 176 as explained later in more detail comprise one or more openings 178 and/or slots to receive one or more locking screws 177 to secure the node fitting 170 to the SSEs 130. Other structures and mechanisms to attach node fitting to the SSEs 130 are contemplated. Node fitting 170, in an embodiment, also includes a mechanism 172, e.g., a channel 174, to receive and connect to interior splines 152. Channel 174, preferably catches interior splines 152 and permits splines 152 to slide with respect to node fitting 170. Optionally, interior spline 152 may later be fixedly connected, preferably permanently fixedly connected, e.g., bonded and/or glued, within channel 174 and to node fitting 170.

The distance "Y" that node fittings 170 extend from SSEs 130 to interior splines 152 may be adjusted to change the geometry and shape of the network of interior splines 152, that will in turn change the surface geometry of the reflector, e.g., the mesh surface. In an embodiment, after assembly of the node fittings 170 to the SSEs 130, and in an aspect after adjustment of distance "Y" that node fittings 170 extend from or stand off of SSEs 130, the node fittings 170 may be fixedly connected, preferably permanently fixedly connected, to the SSEs 130. In an embodiment, the node fittings 170 may be adjustably connected to the SSEs with locking screws 177, and then after the surface of the reflector has been measured, confirmed, and/or adjusted, the node fitting 170 may be permanently fixedly connected using glue.

In an aspect, the support structure or frame 110 may comprise thermoelastically stable graphite composite members, including thermoelastically stable graphite composite ribs 115, SSEs 130, rim assembly 140, adjustable spline supports 160, and splines 150. The design of the reflector 8 in an embodiment includes a fixed, thermoelastically stable graphite composite support structure or frame 110 and a high performance mesh 125 that forms the surface 11 of the reflector. In an aspect, the number and density of connections or interfaces between the support structure and the reflector surface can be varied and or tailored. In particular, the number and density of the adjustable spline supports 160, including the number of adjustable edge spline supports 162 and the number of node fittings 170 can be varied. The reflector design 8 in an embodiment includes the ability to adjust the surface geometry after the surface 11, e.g., in an aspect the splines 150 and mesh 125, has been assembled to the support structure or frame 110. In an aspect, adjustable spline supports 160 supporting the surface 11 of the reflector 8, preferably supporting splines 150 that support the mesh, are adjustable post assembly of the surface 11 to the support structure 110. The adjustable spline supports 160 can later be permanently fixed into position, for example, by bonding and/or gluing into position.

Figure 9A:
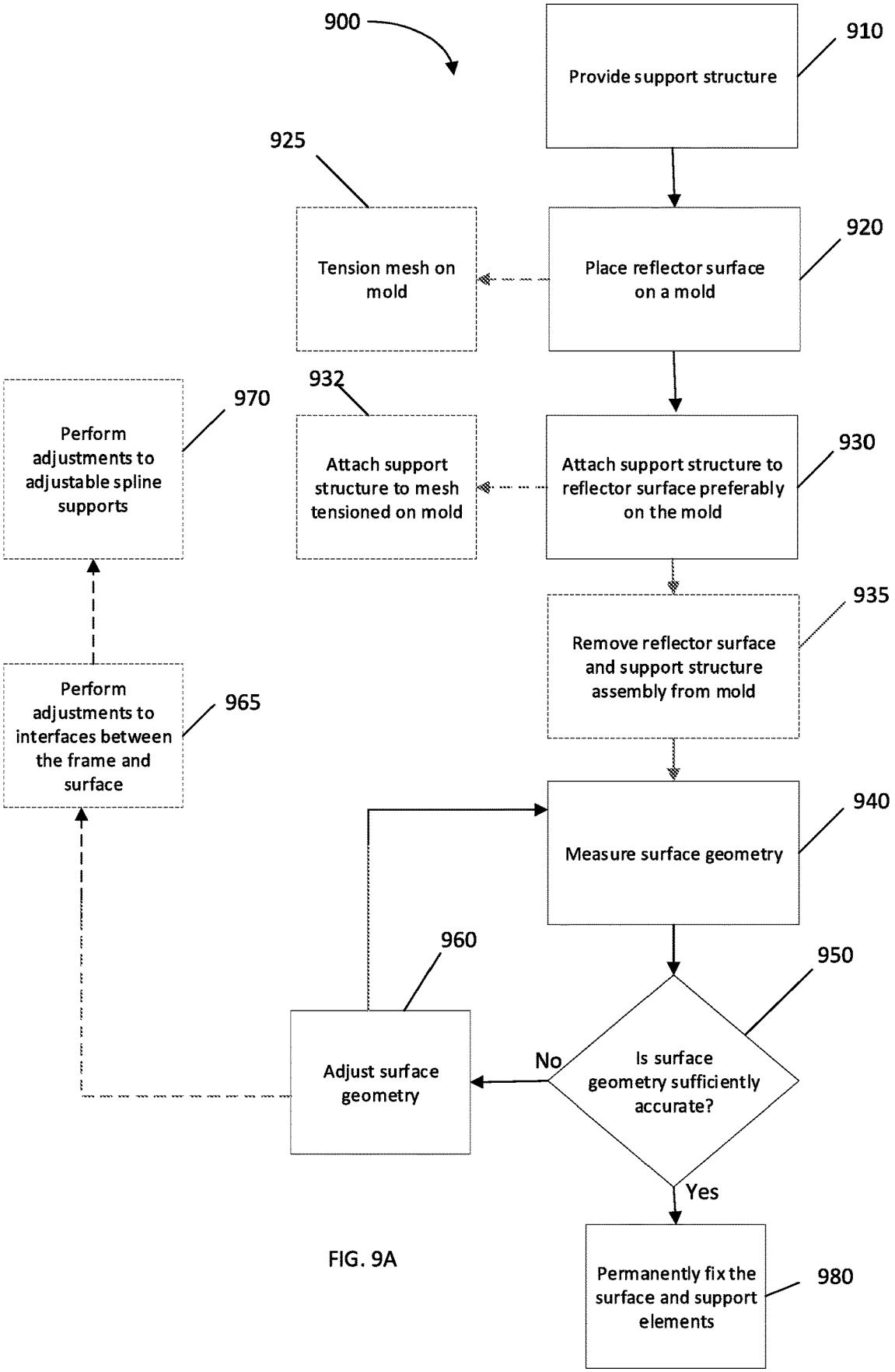
FIG. 9A is a flow chart of a process according to an embodiment for making a reflector antenna.
Figure 9B:
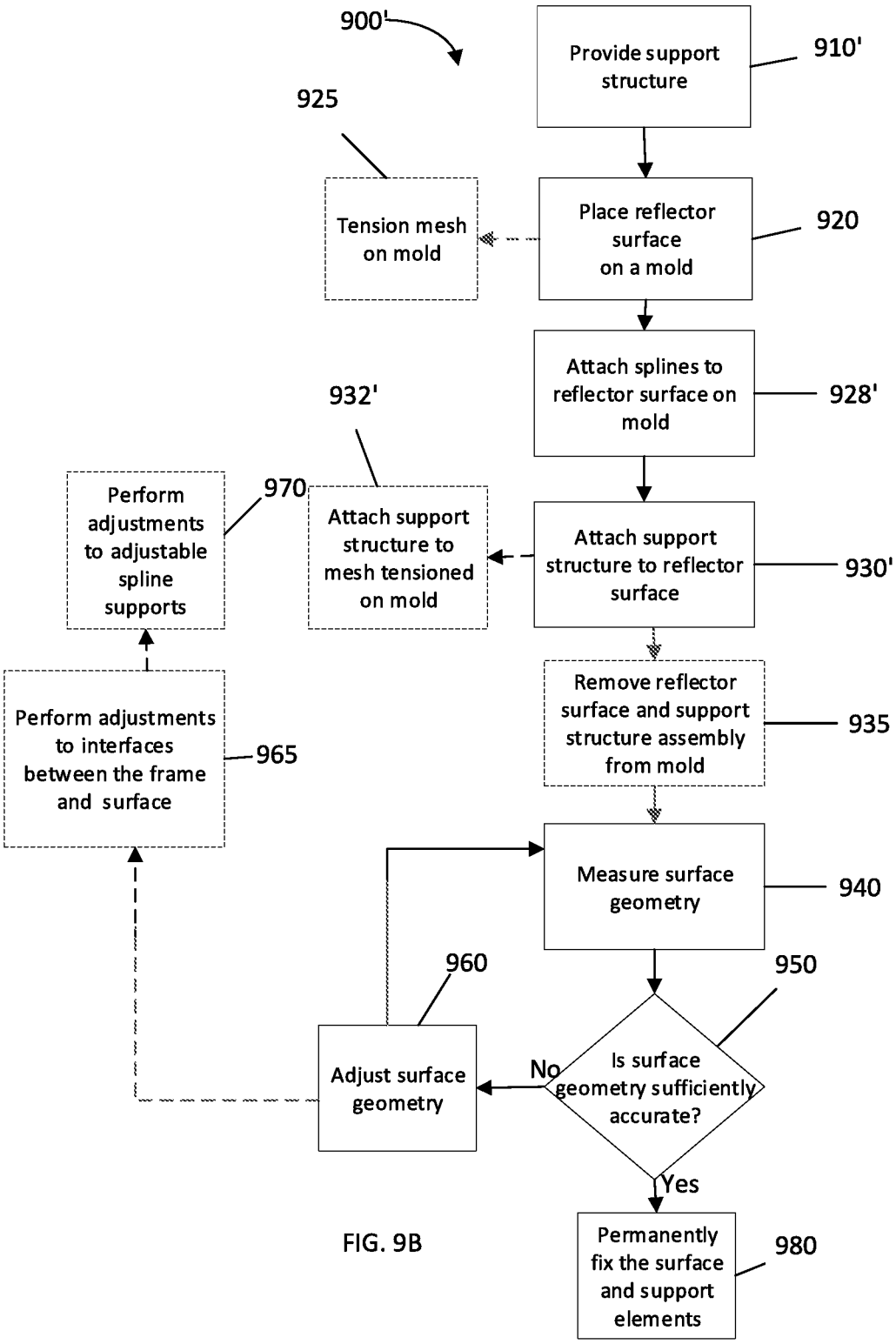
FIG. 9B is a flow chart of a process according to another embodiment for making a reflector antenna.

FIGS. 9A and 9B are exemplary flowcharts in accordance with one or more embodiments illustrating and describing methods of manufacturing a fixed reflector in accordance with embodiments of the present disclosure. While the manufacturing methods 900 and 900' are described for the sake of convenience and not with an intent of limiting the disclosure as comprising a series and/or a number of steps, it is to be understood that the processes do not need to be performed as a series of steps and/or the steps do not need to be performed in the order shown and described with respect to FIGS. 9A and 9B, but the processes may be integrated and/or one or more steps may be performed together, simultaneously, or the steps may be performed in the order disclosed or in an alternate order. In this regard, each block in the flowcharts or block diagrams may represent a module, segment, or portion of a process, which comprises one or more steps for implementing the specified function(s).

Accordingly, blocks of the flowchart illustration support combinations of means for performing the specified functions, and/or combinations of steps for performing the specified functions. It will also be understood that each block of the flowchart illustration, and combinations of blocks in the flowchart illustration, can be implemented by the disclosed embodiments and equivalents thereof, including future developed equivalents.

As shown in the flow diagram of FIG. 9A, a process 900 for manufacturing a reflector antenna, e.g., reflector 8, according to an embodiment is disclosed. At 910, in an embodiment, a frame or support structure is provided that will support the surface 11, e.g., mesh 125, of the reflector. The frame or support structure is preferably assembled, or built, and in an embodiment, the support structure or frame may include one or more support elements, such as for example, one or more support members or ribs 115, one or more spline support elements (SSEs) 130, rim assembly 140, one or more adjustable spline supports 160, and/or one or more splines 150. The frame or support structure may include more or less support elements, and/or different support elements. In an embodiment, the frame 110 includes ribs 115, SSEs 130, rim assembly 140, and one or more adjustment spline supports 160. In an aspect, the frame or support structure 110 may further include one or more splines 150.

The adjustable spline supports 160 in an embodiment are assembled and attached to the frame or support structure 110 and the splines 150. In an embodiment, SSEs 130 are connected to ribs 115, and rim assembly 140 is connected to SSEs 130 and ribs 115 to form a sub-frame or support structure. Adjustable spline supports 160 are connected to the sub-frame. For example, adjustable spline supports 162 are connected to rim assembly 140 and edge spline 154 and/or interior splines 152, and in a further aspect, adjustable spline supports 170, e.g., node fittings 170, are connected to interior splines 152 and SSEs 130. In an embodiment, the adjustable spline supports 160, are assembled to the support structure (sub-frame) and the splines 150 are captured by the adjustable spline supports 160. For example, edge spline supports 162 may be connected to rim assembly 140, and then the edge spline supports 162 are connected to respective interior splines 152 and/or edge spline 154. Node fittings 170 may be connected to SSEs 130, and then the node fittings 170 are connected to respective interior splines 152.

At 920, in an embodiment, the reflector surface is placed over and/or onto a mold. In an embodiment, mesh material may be tensioned on the mold at 925. The mold is preferably highly accurate and facilitates placing or forming the reflector surface, e.g., the mesh, into the proper geometry. The mold surface is typically convex and the reflector surface material, e.g., the mesh, is tensioned over the mold surface so the reflector surface is formed and configured into the proper three-dimensioned shape and geometry, and preferably forms a highly accurate surface.

At 930, the frame or support structure is attached to the reflector surface. As part of the process of attaching the support structure or frame to the reflector surface, the process at 930, may include in an embodiment adjusting the frame, and in particular adjusting the shape of the splines so that the splines interface with, conform to, and/or take the desired three-dimensional shape. In this regard, the adjustable spline supports 160 may be adjusted, and/or the splines 130 will be configured into the desired shape and/or position.

In this regard and according to an embodiment, the adjustable spline supports 160 may be connected to the support structure (e.g., SSEs 130 and rim assembly 140) and the splines 150, but remain adjustably assembled to the splines and support structure. According to an embodiment, the adjustable spline supports 160, e.g., adjustable edge spline supports 162 and adjustable node fittings 170, may be assembled, e.g., attached, to the respective rim assembly 140 and SSEs 130 and adjusted so that the splines 150 take on the desired three-dimensional shape of the reflector, e.g., the shape of the mold.

In an embodiment, the support structure includes the splines, and in an aspect the splines 150 take on the three-dimensional shape and geometry desired for the surface of the reflector. The interior splines 152 in an embodiment are straight, non-curved slender members. In an embodiment, the adjustable spline supports, e.g., adjustable spline supports 160, are connected to the support structure or frame (e.g., support elements, SSEs and/or rim assembly) and to the splines 150, and the splines 150 are configured and/or deformed into the desired three-dimensional shape of the reflector. The splines in an aspect are preferably elastically deformed into the desired configuration, shape and/or position, but may be plastically deformed as well. In a further embodiment, the distance "X" of the adjustable edge spline supports 162 and the distance "Y" of the adjustable spline supports 170 (e.g., node fitting 170) are adjusted so that the splines 150 take on the three-dimensional shape and geometry desired for the surface of the reflector. In an embodiment, a mold may be used to temporarily set the support structure (frame), e.g., position the splines 150, into the desired three-dimensional shape. The mold in an embodiment is the same mold use to place and/or tension the mesh. In this regard, the splines 150 can be pressed against or nearly against the mold so that the splines 150, particularly the interior splines 152, are positioned in the desired shape and the adjustable spline supports 160 set to retain the splines 150 in the desired shape and position. The mold or mold precursor preferably in an aspect has a surface or structure to accurately position and shape the splines.

In an embodiment, the splines 150, (and support structure) may be placed in contact with the mesh, e.g., mesh 125, preferably while the mesh is on the mold. The splines (and support structure) are preferably attached to the mesh at 932, preferably fixably attached to the mesh, e.g., glued to the mesh. In an aspect, the splines 150 are attached to the mesh while the mesh is on the mold. In an embodiment, the splines 150 may be attached to the reflector surface, e.g., mesh, at intervals, and in an aspect the reflector surface, e.g., mesh, is attached to the splines at about every 1.5 inches along the splines. Other distances are contemplated for attachment of the reflector surface, e.g., the mesh, to the splines.

The antenna reflector is removed from the mold at 935 and, at 940, the surface geometry of the reflector is measured. While the mold generally has a highly accurate surface, imperfections and distortions in the surface geometry may occur during the manufacturing process. Errors in the surface geometry may result from errors associated with the mold or manufacturing tooling. Errors in the surface geometry may also result from spring back associated with the splines.

The surface geometry is measured, and at 950, it is determined whether or not the surface geometry of the reflector is sufficiently accurate. If the surface geometry is sufficiently accurate (950: Yes), then at 980 the process in an aspect includes fixedly connecting, preferably permanently fixedly connecting, the surface, e.g., the mesh and/or mesh/spline combination, and the support structure or frame. In an embodiment, the various interfaces, joints, and or connections between the support structure elements, e.g., the splines, the adjustable spline support elements, the SSEs, the rim assembly, the ribs, etc., are fixedly connected to provide a rigid structure of improved dimensional accuracy.

After fixing the surface, e.g., mesh and/or mesh/spline combination, to the support structure, and fixing the support structure, particularly the adjustable spline supports, e.g., the edge spline supports and node fittings, in an embodiment, no further adjustments to the surface of the reflector can be made, i.e., in an embodiment the adjustable spline supports are no longer adjustable. In a preferred embodiment, the interfaces, connections, and joints between the structural support or frame and the reflector surface are permanently fixedly connected such that the connection, interface, or joint is desirably permanently fixed and not intended to be loosened or undone. In one example, the connection, interface, or joint would require destruction of the interface, joint, connection or support structure such that they would require replacement. The interfaces, connections, and joints in an embodiment may be permanently fixedly connected by gluing, bonding, welding, soldering, or other means.

If the surface geometry is not sufficiently accurate (950: No), then the geometry of the surface of the reflector is adjusted at 960. The surface geometry of the reflector is adjusted in an embodiment by adjusting one or more adjustable spline supports 160, e.g., one or more adjustable node fittings 170 and/or more adjustable edge spline supports 162. After adjusting the surface geometry of the reflector, e.g., the surface geometry of the mesh, the geometry of the surface is remeasured at 940 and the processes at 950, 960, and 940 are repeated until the geometry of surface is sufficiently accurate for the intended operation of the reflector.

The manner and technique for adjusting the geometry of the mesh surface at 960 may take several forms and require several adjustments, and may include, in an embodiment at 965, performing adjustments to the reflector surface at one or more interfaces between the surface and the frame. In an aspect, adjustments are made to adjust the positioning of one or more splines 150 supporting the surface 11. In an aspect, at 970 adjustable spline supports 160, such as, for example, adjustable edge spline supports 162 and/or node fittings 170, may be adjusted to reposition, reshape, and/or reconfigure the reflector surface, e.g., the mesh surface. In an aspect, adjustments may be made to one or more standoffs or stanchions in the edge spline supports 162 to reduce errors in the surface geometry. Adjustments to the edge spline supports 162 in an embodiment adjusts the edge spline 154 and/or the interior splines 152. In another aspect, adjustments may be made to one or more node fittings 170 to reposition the interior splines 152 to reduce errors in the surface geometry.

FIG. 9B discloses an alternative process 900' for manufacturing a reflector antenna, e.g., reflector 8. At 910', in an embodiment, a sub-frame or support structure, e.g., support structure 110, is provided that will support the surface 11, e.g., mesh 125, of the reflector. The sub-frame or support structure is preferably assembled, or built, and in an embodiment, the support structure or frame may include one or more support elements, such as for example, one or more support members or ribs 115, one or more spline support elements (SSEs) 130, a rim assembly 140, and one or more adjustable spline supports 160. The frame or support structure may include more or less support elements, and/or different support elements. In this embodiment, the sub-frame or support structure does not include one or more splines 150.

The adjustable spline supports 160 in an embodiment are assembled and attached to a sub-frame or support structure. In an embodiment, SSEs 130 are connected to ribs 115, and rim assembly 140 is connected to SSEs 130 and ribs 115 to form a sub-frame or support structure. Adjustable spline supports 160 are connected to the sub-frame. In a further embodiment, adjustable spline supports 162 are connected to rim assembly 140, and in a further aspect, adjustable spline supports 170, e.g., node fittings 170, are connected to SSEs 130.

In the process of FIG. 9B, at 920, in an embodiment, the reflector surface is placed over and/or onto a mold. In an embodiment, mesh material may be tensioned on the mold at 925. The mold is preferably highly accurate and facilitates placing or forming the reflector surface, e.g., the mesh, into the proper geometry. The mold surface is typically convex and the reflector surface material, e.g., the mesh, is tensioned over the mold surface so the reflector surface is formed and configured into the proper three-dimensioned shape and geometry, and preferably forms a highly accurate surface.

In an embodiment, the splines, e.g. splines 150, at 928', are attached to the reflector surface, e.g., mesh, without the support structure or subframe, and preferably while the reflector surface, e.g. mesh, is on the mold, tensioned on the mold. The splines 150, and in particular the interior splines 152 in an embodiment are straight, non-curved slender, elongated members. The splines in an aspect are configured and/or deformed into the desired three dimensional shape of the reflector surface, preferably using the mold. The splines in an aspect are elastically deformed into the desired shape, position and/or configuration and in an embodiment may be plastically deformed as well. The shaping of the splines may be performed before, during, and/or after placing the splines on the mold.

In an embodiment, the splines 150, may be placed in contact with the reflector surface, e.g., mesh 125, preferably while the mesh is on the mold. The splines are preferably attached to the reflector surface, e.g., mesh, at 928', preferably fixably attached to the mesh, e.g., glued to the mesh. In an aspect, the splines 150 are attached to the mesh while the mesh is on the mold. In an embodiment, the splines 150 may be attached to the reflector surface, e.g., mesh, at intervals, and in an aspect the reflector surface, e.g., mesh, is attached to the splines at about every 1.5 inches along the splines. Other distances are contemplated for attachment of the reflector surface, e.g., the mesh, to the splines.

At 930' the reflector surface/spline assembly is attached to the support structure. In an embodiment, the splines 150 of the mesh/spline assembly are attached to the sub-frame preferably while the mesh/spline assembly is on the mold. In a further aspect, the adjustable spline supports, e.g., adjustable spline supports 160, are connected to the splines 150 of the mesh/spline assembly. The adjustable spline support 160, e.g., the edge spline supports 162 and node fittings 170, are adjusted to attach to the splines 150, e.g., edge spline 154 and/or interior splines 152, while the mesh/spline assembly is in the desired shape, and preferably while the mesh/spline assembly is on the mold.

If the mesh/spline assembly is attached to the subframe, including to the adjustable spline supports 160, while on the mold, the antenna reflector is removed from the mold at 935, and at 940 the surface geometry of the reflector is measured. The process 900' has the same process steps 940, 950, 960, 965, 970 and 980 as process 900 shown in FIG. 9A and described above.

As described above, the surface of the reflector is assembled to the support structure (e.g., frame) and built to have a highly accurate surface. According to an aspect of the disclosure, after the surface, e.g., mesh, is assembled to the support structure, adjustments can be made at numerous interfaces to increase the dimensional accuracy of the reflector surface. According to an embodiment, adjustable spline supports 160 are provided which can be later adjusted after assembly of the reflector, and then fixedly connected, preferably permanently fixedly connected, in position to obtain a highly accurate surface. As indicated above, the adjustable spline supports 160 may take many forms, e.g., edge spline supports 162 and/or node fittings 170. The adjustable spline supports 160 can move or adjust the position of the splines 150, preferably interior splines 152 and edge spline 154, and hence the reflector surface, e.g., the shape of the mesh surface, preferably with respect to the frame or support structure. The methods and mechanisms to adjust the positioning and repositioning of the adjustable spline supports 160 also may take on numerous configurations and forms.

Figure 10A:
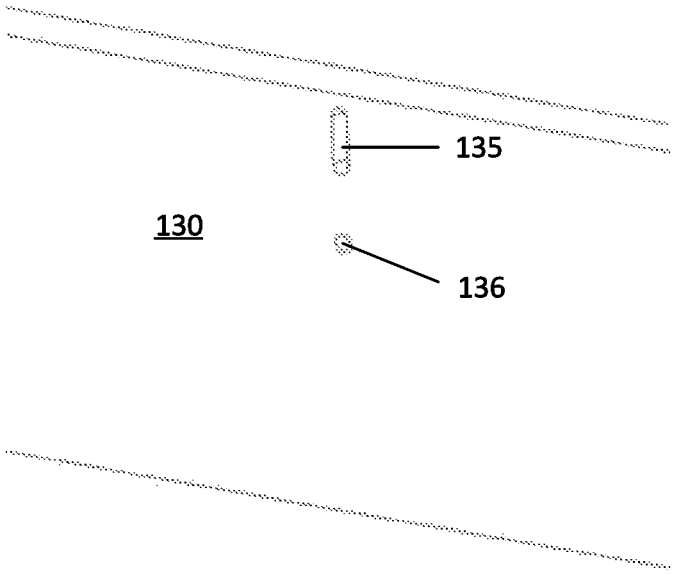
FIG. 10A is a side perspective view of a support structure for an adjustable node fitting.
Figure 10B:
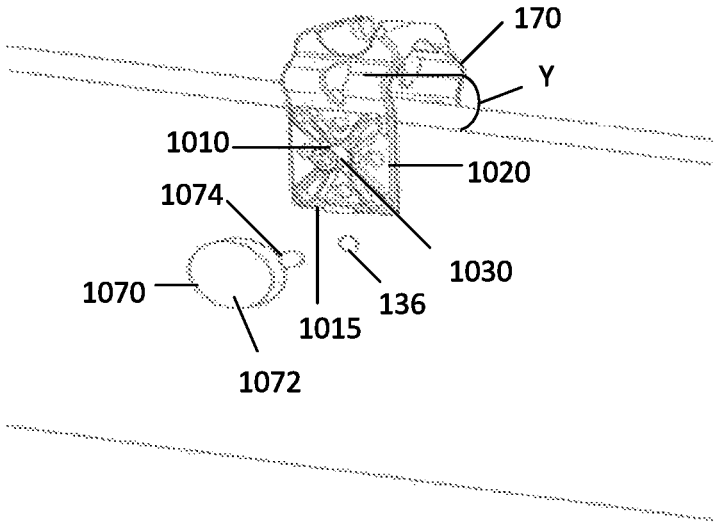
FIG. 10B is a side perspective view of an embodiment of a node fitting adjustment mechanism and node fitting.
Figure 10C:
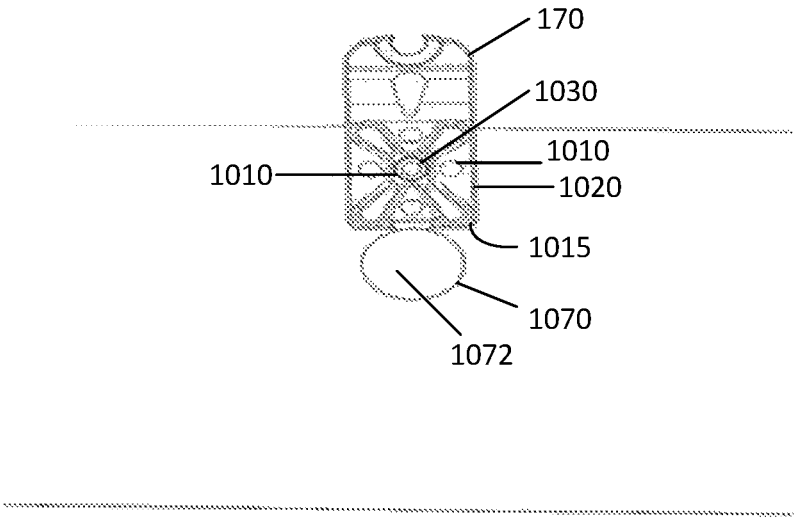
FIG. 10C is a side view of an embodiment of the node fitting adjustment mechanism and node fitting of FIG. 10B in use.

In an embodiment, a process and mechanism for adjusting or repositioning adjustable node fitting 170 is shown in FIGS. 10A-10C. Node fitting 170 includes one or more openings 1010 in flanges 1020. The flanges 1020 fit over the SSE 130 and one or more openings 1010 are aligned with one or more vertical slots 135 (shown in FIG. 10A) formed in SSE 130. One or more locking screws 1030 are inserted into the one or more openings 1010 formed in the flanges 1020 and aligned with the vertical slots 135 to permit (vertical) adjustment of the node fittings 170 with respect to the SSE 130. One of the flanges 1020 in an embodiment has one or more threaded openings 1010 to receive the locking screws 1030 and the openings 1010 on the other flange has a clearance hole with a smooth surface and no internal threads to permit the shaft of the locking screw 1030 to pass easily through. The one or more locking screws 1030 secure the flanges 1020 and the node fitting 170 to the SSE 130. Vertical slot 135 permits vertical movement of the node fitting 170 to adjust the distance "Y" that the node fitting 170 extends above the SSEs. One or more holes 136 are formed in the SSE 130 outside the perimeter where the flanges 1020 attach to the SSE 130 to receive a node fitting adjustment mechanism 1070, also referred to as an adjustment gage. The adjustment gage 1070 is similar to a pin, and has a head 1072 for abutting against the node fitting 170 and a body 1074 extending from the head 1072 configured and adapted to be inserted into the hole 136 in SSE 130.

During assembly of the reflector, the node fitting 170 is secured to SSE 130 with one or more locking screws 1030 inserted through openings 1010 in the flanges 1020 and the one or more vertical slots 135. The locking screws 1030 are tightened when the splines 152 are moved into the desired position to temporarily set the interior splines 152 into position. After the mesh is attached to the frame, including the node fittings 170 attached to the network of interior splines 152, the surface geometry of the reflector is measured and it is determined which splines 150 need adjusting and by how much to provide a more dimensionally accurate surface for the reflector. In this regard, the distance "Y" that node fitting 170 holds splines 152 away from SSEs 130 can be adjusted to change the shape and accuracy of the reflector surface.

In one embodiment, the process includes determining the size of adjustment gage 1070. In an aspect, the locking screws 1030 are loosened, the adjustment gage 1070 is installed on the SSE 130 using holes 136 formed in the SSE 130, the node fitting 170 is moved until it touches the adjustment gage 1070, and the locking screws 1030 are thereafter tightened. The adjustment gage 1070 abuts against the node fitting 170, and particularly the top surface 1015 of one or more flanges 1020 of the node fitting 170 as shown in FIG. 10C, to accurately set the position of and to reduce the possibility of (e.g., prevent) the node fitting 170 from moving out of position. To determine the size of the adjustment gage 1070, the largest adjustment gage 1070' that will fit into hole 136 with head 1072' abutting the node fitting is determined. That largest adjustment gage 1070' forms the basis to determine the adjustment gage 1070 to use when repositioning the node fitting 170. In an aspect, the amount the node fitting 170 needs to be repositioned is calculated, and adjustment gage 1070 is selected that will permit the node fitting 170 to move and have the adjustment gage 1070 contact the top surface 1015 of the one or more flanges 1020 and properly position the node fitting 170. This process may be performed multiple times to one or more node fittings 170. After the adjustments have been made and the surface of the reflector is in the desired position, the node fittings 170 may be fixedly connected, preferably permanently affixed, to the SSEs 130, e.g., by gluing and/or bonding node fittings 170 to SSEs 130. The interior splines 152 may also be fixedly connected, preferably permanently affixed, to the node fittings 170. In this regard, the interior splines 152 may be fixed in channel 174, preferably glued in channel 174.

Figure 10D:
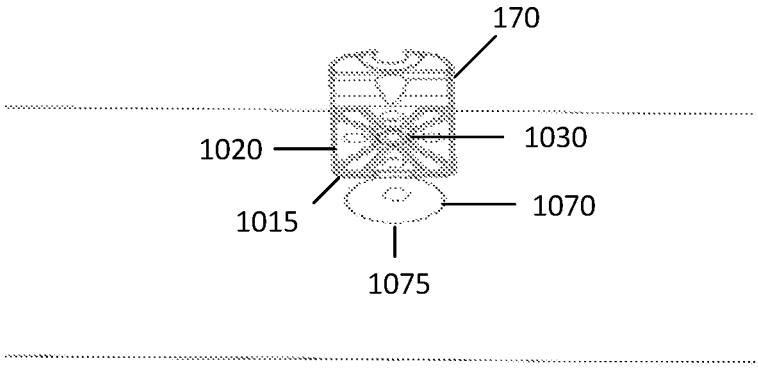
FIG. 10D is a side view of another embodiment of a node fitting adjustment mechanism and node fitting.

In another embodiment shown in FIG. 10D, adjustment gage 1070 may be a cam 1075, whose outer surface (circumference) changes distance from its center. In this embodiment, adjustments are made by rotating cam 1075 to adjust the surface of the reflector. In an aspect, the locking screws 1030 are loosened, the cam 1075 is rotated so that it contacts and abuts against the top surface 1015 of the node fitting 170 on the SSE 130 to adjust the distance "Y" that the interior spline 152 extends from the SSE 130, which in turn adjusts the surface of the reflector. After the cam 1075 is adjusted, the locking screws 1030 are tightened to hold the node fitting 170 in position. When the reflector has the desired geometry, the node fittings 170 may be fixedly connected to SSEs 130, preferably permanently fixed, e.g., by gluing or bonding, into position on the SSEs 130. The interior splines 152 may also be fixedly connected, preferably permanently affixed, to the node fittings 170. In this regard, the interior splines may be fixed in channel 174, preferably glued in channel 174.

Figure 10E:
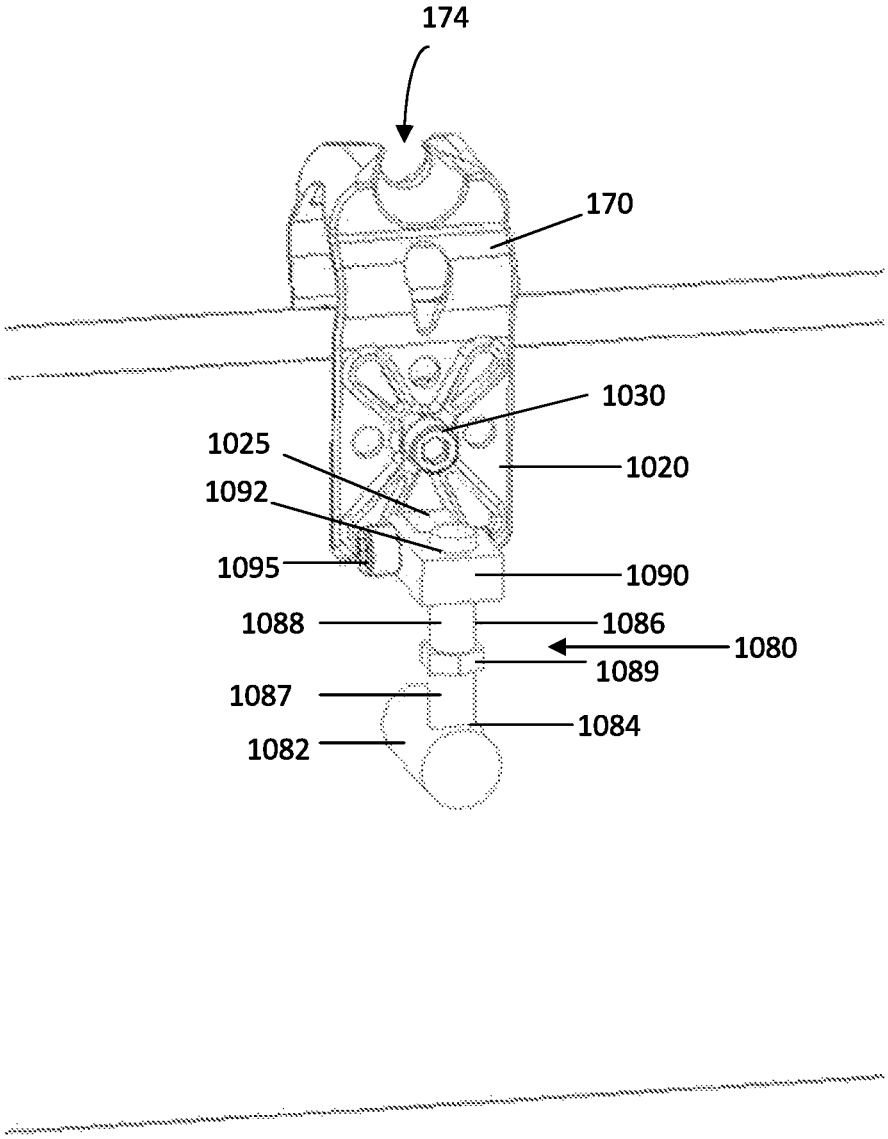
FIG. 10E is a side view of still another embodiment of a node fitting adjustment mechanism and node fitting.

In yet a further embodiment, a process and mechanism for adjusting node fittings 170 is shown in FIG. 10E. As with earlier embodiments, flanges 1020 fit over SSEs 130 so that vertical slots 135 (shown in FIG. 10A) in SSE 130 align with openings 1010 in the flanges 1020 to receive locking screws 1030 in a manner that permits the node fitting 170 to be vertically adjusted on SSE 130. One or more holes 136 are formed in the SSE 130 outside the perimeter of flanges 1020 to receive node fitting adjustment mechanism 1080.

Node fitting adjustment mechanism 1080 includes a shaft 1082 that extends into one or more holes 136 in the SSE 130 and extends outward from the SSE 130. The shaft 1082 has an opening 1084 with internal threads 1085 (not shown) to receive threaded rod 1086. Threaded rod 1086 has two threaded portions 1087 and 1088 which both have two different thread pitches. Threaded rod 1086 also has a rotation adjustment portion 1089 to permit and facilitate rotation of threaded rod 1086. Adjustment portion 1089 may take the form of a nut fixed to the threaded rod 1086. Threaded rod 1086 is received in an opening 1092 in an extension portion 1090. The extension portion 1090 interfaces with, e.g., is attached to, a clamp interface portion 1025 on the flange 1020 of the node fitting 170. Extension portion 1090 may be attached to interface portion 1025 provided on node fitting 170 using a screw or bolt 1095, preferably in a manner so there is no movement between extension portion 1090 and interface portion 1025. Opening 1092 has internal threads 1094 (not shown) for receiving the threaded rod 1086. In particular, threaded portion 1087 of threaded rod 1086 is received in and interfaces with internal threads 1085 (not shown) in opening 1084 of shaft 1082 while threaded portion 1088 of threaded rod 1086 is received in and interfaces with internal threads 1094 (not shown) in opening 1092 in extension portion 1090. Threaded portion 1087 has a different thread pitch than threaded portion 1088 so that rotation of threaded rod 1086 within shaft 1082 and extension portion 1090 changes the distance between shaft 1082 and extension portion 1090 to move the node fitting 170 vertically on SSE 130. In one embodiment, threaded section 1087 has #2-56 threads while threaded section 1088 has #2-64 threads. One skilled in the art can appreciate that other thread pitches can be used for threaded sections 1087 and 1088.

To adjust the node fitting 170 using node fitting adjustment mechanism 1080, the one or more locking screws 1030 attaching the node fitting 170 to the SSE 130 would be loosened and the desired adjustment of the node fitting 170 on SSE 130 would be made by rotating adjustment portion 1089 in the proper direction to vertically adjust node fitting 170 on SSE 130. Rotation of threaded rod 1086 in one direction moves extension section 1090 closer to shaft 1082 and shortens the distance between interior spline 152 and SSE 130. Rotation of threaded rod 1086 in the other direction moves extension section 1090 further apart from shaft 1082 and moves interior splines 152 further from SSE 130. The locking screws 1030 would then be tightened to set the position of the node fitting 170. In embodiments, the node fitting adjustment mechanism 1080 could be removed, and/or optionally the node fittings 170 could be fixedly connected, preferably permanently affixed, e.g., bonded and/or glued, to SSEs 130. To remove node fitting adjustment mechanism 1080, screw or bolt 1095 is removed.

Figure 11:
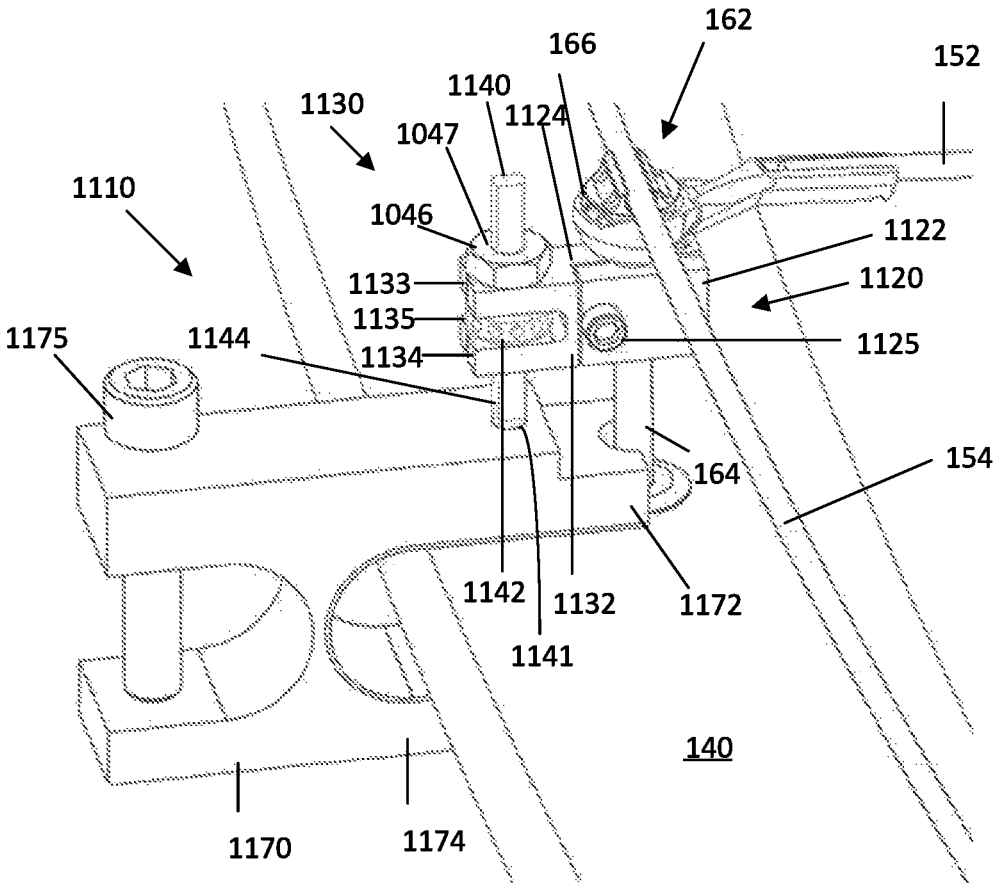
FIG. 11 is a side perspective view of an embodiment of a spline support adjustment mechanism and adjustable spline support.

In addition to adjusting node fittings 170 in order to adjust, reposition and/or reconfigure interior splines 152 to adjust the geometry of the surface of the reflector, edge spline 154 may also be adjusted and/or repositioned by adjusting edge spline supports 162 (in addition to and/or alternatively to node fittings 170). FIG. 11 illustrates an exemplary edge spline support adjustment mechanism 1110 to adjust the distance that edge spline 154 extends from rim assembly 140. Edge spline 154 is received by and attached to base fitting 166 of adjustable edge spline 162. The distance "X" that base fitting 166 and hence edge spline 154 extends from rim assembly 140 in an embodiment is adjusted by adjustment mechanism 1110. In an aspect, adjustment mechanism 1110 also adjusts the distance that interior spline 152 extends from the support structure or frame, e.g., rim assembly 140 and/or SSEs 130.

Edge spline adjustment mechanism 1110 includes a clamp assembly 1120, adjustment assembly 1130, a threaded rod 1140, and optional base clamp 1170. Clamp assembly 1120 includes a first portion 1122 and a second portion 1124 that fit about and attach to the standoff or stanchion 164. Bolt 1125 tightens clamp assembly 1120 on stanchion 164 of edge spline support 162. Clamp assembly 1120 preferably is fixedly connected to stanchion 164 and/or base fitting 166 so that it does not move relative to those components. In an embodiment, an upward force on clamp assembly 1120 places an upward force, e.g., upward movement, on stanchion 164 while a downward force on clamp assembly 1120 places a downward force, e.g., downward movement, on stanchion 164.

Second portion 1124 of clamp assembly 1120, in an embodiment, forms base 1132 of adjustment assembly 1130. Adjustment assembly 1130 includes base 1132, upper portion 1133 and lower portion 1134. A space 1135 is provided between upper portion 1133 and lower portion 1134 to receive thumb wheel 1142 there between. A first opening 1136 (not shown) for receiving threaded rod 1140 is provided in upper portion 1133 and a second opening 1138 (not shown) for receiving threaded rod 1140 is provided in lower portion 1134. First opening 1136 and second opening 1138 preferably do not contain any threads. Threaded rod preferably slides through openings 1136 and 1138 and in an embodiment slides through assembly 1130, but does not rotate with respect to adjustment assembly 1130.

Threaded rod 1140 in an embodiment is keyed such that it has an asymmetrical cross section. For example, threaded rod 1140 may have a flat surface such that it has a "D" shaped cross section, and openings 1136 and 1138 have "D" shaped openings to receive threaded rod 1140 so that the threaded rod does not rotate in openings 1136 and 1138, but may move, e.g., slide in the openings 1136 and 1138. A thumb wheel 1142 with an opening 1148 (not shown) having internal threads 1145 (not shown) is provided in space 1135 and receives threaded rod 1140 as illustrated in FIG. 11. Threaded rod 1140 is also inserted into and interfaces with internal threaded opening 1047 on locking nut 1046.

The end 1141 of threaded rod 1140 is inserted into and interfaces with internal threaded opening 1177 on base clamp 1170 and is attached, preferably bonded and/or glued, to base clamp 1170 so that it does not rotate in the opening. Base clamp 1170 includes finger portions 1172 and 1174 that extend about and clamp to rim assembly 140, and a locking bolt 1175 that by adjustment (e.g., rotation) applies force to finger portions 1172 and 1174 to firmly attach the base clamp 1170 to the rim assembly 140.

In operation, to adjust the adjustable edge spline support 162, e.g., to change the distance that edge spline 154 extends away from rim assembly 140, the thumb wheel 1142 is rotated to apply a force through clamp assembly 1020 to the edge spline support 162. In more detail, rotation of thumb wheel 1142 on threaded rod 1140 moves adjustment assembly 1130 relative to threaded rod 1140 to lengthen or shorten the extension 1144 that extends from adjustment assembly 1130 toward rim assembly 140. In particular, rotation of thumb wheel 1142 in the appropriate direction lengths extension 1144 which applies an upward force on adjustment assembly 1130 and clamp assembly 1120 which moves stanchion 164 relative to the rim assembly 140. Rotation of the thumb wheel 1142 in the other direction shortens extension 1144 which permits stanchion 164 to move relative to rim assembly 140.

Figure 12:
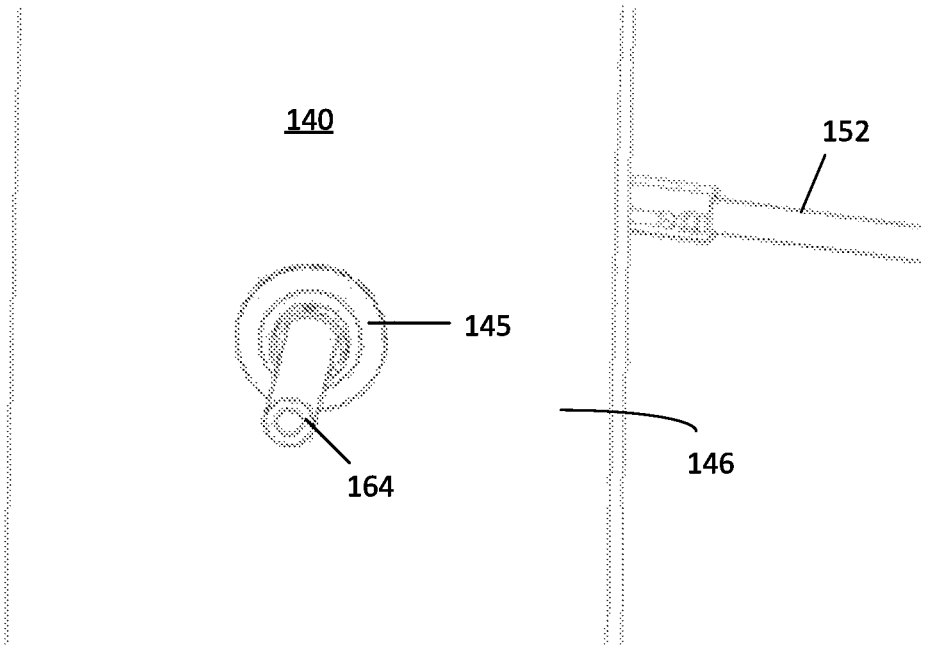
FIG. 12 is a bottom perspective view of an embodiment of a support structure and an adjustable spline support.

To adjust edge spline adjustment mechanism 1110, locking nut 1046 is loosened and thumb wheel 1142 is rotated in the appropriate direction to move adjustable edge spline support 162. The pitch of the threaded rod 1140 determines how much adjustment occurs with rotation of the thumb wheel 1142. In one embodiment, thumb wheel 1142 has detents which are set so that one interval of movement between ticks of the detent mechanism moves the adjustable edge spline support 162 a specific distance. In an embodiment, one tick of thumbwheel 1142 between detent intervals moves the threaded rod 1140 by 0.0021 inches. Once the base fitting 166 is in the proper position with respect to the rim assembly 140, the locking nut 1046 is tightened against upper portion 1133 of adjustment assembly 1130. In this manner, the position and/or distance "X" of edge spline 154 from the rim assembly 140 is set. Once the position of the edge spline 154, and the respective interior splines 152 are set, and the surface geometry of the reflector is in the desired position, the stanchion 164 is fixedly connected, preferably permanently fixed, to the rim assembly. In one embodiment, the stanchion 164 is bonded or glued to the rim assembly, preferably fillet bonded to the rim assembly. As shown in FIG. 12, the stanchion 164 may be bonded and/or glued from the underside of rim assembly 140.

It will be appreciated that one or more adjustments may be made to one or more adjustable spline support mechanisms, and that adjustments can be made to a multitude of adjustable spline supports to obtain the desired surface geometry for the reflector. For example, one or more adjustments may be made to edge spline supports and/or the node fittings described herein. As will be appreciated, other adjustment mechanisms, including other node adjustment mechanisms, and other edge spline support adjustment mechanisms may be used, and the invention should not be limited to the particular adjustment mechanisms shown unless explicitly claimed.

While the foregoing description has particular application to fixed mesh reflectors, reflectors greater than 2 meters and preferably less than 5 meters, and/or for operational frequencies for Ka-band and V-band, the foregoing description has broad application. It should be appreciated that the concepts disclosed herein may apply to many types of reflectors or antennas, in addition to those described and depicted herein. For example, the concepts may apply to a smaller or larger reflector, or solid surface reflector, and/or reflectors configured for different operational frequencies. The discussion of any embodiment is meant only to be explanatory and is not intended to suggest that the scope of the disclosure, including the claims, is limited to these embodiments.

Those skilled in the art will recognize that the reflector has many applications, may be implemented in various manners and, as such is not to be limited by the foregoing embodiments and examples. Any number of the features of the different embodiments described herein may be combined into a single embodiment. The support structure or frame may be varied and the locations and positions of particular elements, for example, the splines, the spline support elements (SSEs), the ribs, etc., may be altered. Alternate embodiments are possible that have features in addition to those described herein or may have less than all the features described. Functionality may also be, in whole or in part, distributed among multiple components, in manners now known or to become known.

It will be appreciated by those skilled in the art that changes could be made to the embodiments described above without departing from the broad inventive concept. It is understood, therefore, that this invention is not limited to the particular embodiments disclosed, but it is intended to cover modifications within the spirit and scope of the invention. While fundamental features have been shown and described in exemplary embodiments, it will be understood that omissions, substitutions, and changes in the form and details of the disclosed embodiments of the reflector may be made by those skilled in the art without departing from the spirit of the invention. Moreover, the scope of the invention covers conventionally known, and future-developed variations and modifications to the components described herein as would be understood by those skilled in the art.

Furthermore, although individually listed, a plurality of means, elements, or method steps may be implemented by, e.g., a single unit, element, or piece. Additionally, although individual features may be included in different claims, these may advantageously be combined, and their inclusion individually in different claims does not imply that a combination of features is not feasible and/or advantageous. In addition, singular references do not exclude a plurality. The terms "a", "an", "first", "second", etc., do not exclude a plurality. Reference signs or characters in the disclosure and/or claims are provided merely as a clarifying example and shall not be construed as limiting the scope of the claims in any way.

Accordingly, while illustrative embodiments of the disclosure have been described in detail herein, it is to be understood that the inventive concepts may be otherwise variously embodied and employed, and that the appended claims are intended to be construed to include such variations, except as limited by the prior art.

The invention claimed is:

1. An antenna reflector comprising:

a reflector surface;

a plurality of spline support elements;

a plurality of ribs structurally supporting the reflector surface and the plurality of spline support elements;

a plurality of splines fixedly connected to the reflector surface; and a plurality of adjustable spline supports attachable to the plurality of spline support elements, and configured and adapted to retain the plurality of splines, wherein at least one of the adjustable spline supports is configured and adapted to be adjustably repositionable with respect to the plurality of spline support elements to change a configuration of at least one spline of the plurality of splines in a first mode, and also configured and adapted to be fixedly connected to the plurality of spline support elements in a second mode.

2. The antenna reflector of claim 1, wherein the reflector surface comprises a mesh formed of conductive filaments with openings and the mesh is fixedly connected to the plurality of splines.

3. An antenna reflector comprising:

a reflector surface;

a plurality of spline support elements;

a plurality of splines fixedly connected to the reflector surface; and a plurality of adjustable spline supports attachable to the plurality of spline support elements, and configured and adapted to retain the plurality of splines, wherein at least one of the adjustable spline supports is (i) configured and adapted to be adjustably repositionable with respect to the spline support elements to change a configuration of at least one spline of the plurality of splines in a first mode, and (ii) also configured and adapted to be fixedly connected to the plurality of spline support elements in a second mode; and a plurality of generally parallel interior splines, and the plurality of adjustable spline supports include node fittings for retaining the interior splines, the node fittings having at least one flange with one or more flange openings for receiving one or more locking screws, the node fittings being adjustably repositionable with respect to the spline support elements in the first mode by loosening and tightening at least one of the locking screws, and thereafter being fixedly connected to the spline support elements in the second mode.

4. The antenna reflector of claim 3, wherein the spline support element has one or more vertical slots aligned with at least one of the one or more flange openings, the at least one locking screw extending through the flange opening and at least one of the vertical slots to secure the node fitting to the spline support element and permit repositioning of the node fitting, the spline support element further comprising one or more openings associated with and configured to be in proximity to the at least one flange of the node fitting, the openings further configured and adapted to receive at least a portion of a node fitting adjustment mechanism to adjust and reposition the node fitting on the spline support element in the first mode.

5. The antenna reflector system of claim 4, wherein the node fitting adjustment mechanism includes a portion for abutting against the flange of at least one node fitting.

6. An antenna reflector comprising:

a reflector surface;

a plurality of spline support elements;

a plurality of splines fixedly connected to the reflector surface;

a plurality of adjustable spline supports attachable to the spline support elements, and configured and adapted to retain the splines, wherein at least one of the adjustable spline supports is (i) configured and adapted to be adjustably repositionable with respect to the spline support elements to change a configuration of at least one spline of the plurality of splines in a first mode, and (ii) also configured and adapted to be fixedly connected to the plurality of spline support elements in a second mode;

a rim assembly;

an edge spline; and a plurality of edge spline supports for retaining the edge spline, the plurality of edge spline supports being attachable to the rim assembly, wherein at least one edge spline support of the plurality of edge spline supports is configured and adapted to be adjustably repositionable with respect to the rim assembly to change the configuration of at least one spline in the first mode, and the at least one edge spline support is fixedly connected to the rim assembly in the second mode.

7. The antenna reflector of claim 6, wherein the edge spline support comprises a base fitting for receiving the edge spline and a stanchion receivable and repositionable with respect to the rim assembly in the first mode, and thereafter when the desired configuration of the edge is achieved, being fixedly connected to the rim assembly in the second mode.

8. The antenna reflector of claim 7, wherein the edge spline support further comprises a pivot fitting for receiving at least one interior spline, the pivot fitting adjustably positionable with respect to the base fitting in the first mode and fixedly connected to the edge spline support in the second mode.

9. An antenna reflector kit system comprising a wire mesh configurable into a reflector surface;

a plurality of spline support elements;

a plurality of ribs connectable to structurally support the reflector surface and the plurality of spline support elements;

a plurality of splines connectable to the wire mesh to form the reflector surface;

a plurality of adjustable spline supports, each adjustable spline support connectable to at least one spline; and a plurality of spline support adjustment mechanisms configurable for adjusting the position or configuration of the adjustable spline supports with respect to the spline support elements to reposition the splines to alter the shape of the reflector surface.

* * * * *